US005220935A

United States Patent [19]

Bailey et al.

[11] Patent Number: 5,220,935

[45] Date of Patent: Jun. 22, 1993

[54] APPARATUS AND METHOD FOR CLEANING WITH A FOCUSED FLUID STREAM

[75] Inventors: Donald C. Bailey, Charleston; Richard E. Cruzan, N. Charleston, both of S.C.

[73] Assignee: Carolina Equipment & Supply Co., Inc., North Charleston, S.C.

[21] Appl. No.: 635,949

[22] Filed: Dec. 28, 1990

[51] Int. Cl.[5] ..... B08B 3/02

[52] U.S. Cl. ..... 134/102.1; 134/122 R; 134/181; 134/199

[58] Field of Search ..... 134/122 R, 64 R, 199, 134/56 R, 172, 181, 100.1, 102.1

[56] References Cited

U.S. PATENT DOCUMENTS

| | | | |
|---|---|---|---|
| 2,664,929 | 1/1954 | Simons . | |
| 3,840,185 | 10/1974 | Ruthardt . | |
| 3,877,643 | 4/1975 | Smith et al. . | |
| 3,933,519 | 1/1976 | Koch et al. | 134/172 |
| 3,987,964 | 10/1976 | Pittman et al. . | |
| 4,166,754 | 9/1979 | Scheel et al. . | |
| 4,170,420 | 10/1979 | Underwood . | |
| 4,205,694 | 6/1980 | Thompson et al. | 134/199 |
| 4,229,121 | 10/1980 | Brown . | |
| 4,241,878 | 12/1980 | Underwood . | |
| 4,253,611 | 3/1981 | Hart . | |
| 4,421,722 | 12/1983 | Massey et al. . | |
| 4,537,639 | 8/1985 | Shook | 134/34 X |
| 4,552,594 | 11/1985 | Voskuilen et al. | 134/199 X |
| 4,607,794 | 8/1986 | Horwood . | |
| 4,640,644 | 2/1987 | Puchala et al. . | |
| 4,648,215 | 3/1987 | Hashish et al. . | |
| 4,677,998 | 7/1987 | van Voskuilen et al. . | |
| 4,715,539 | 12/1987 | Steele . | |
| 4,744,517 | 5/1988 | Iwamoto et al. . | |
| 4,761,039 | 8/1988 | Hilaris . | |
| 4,773,113 | 9/1988 | Russell | 134/172 X |
| 4,795,217 | 1/1989 | Hilaris . | |
| 4,798,339 | 1/1989 | Sugino et al. . | |
| 4,806,172 | 2/1989 | Adaci et al. | 134/167 R X |
| 4,813,611 | 3/1989 | Fontana . | |
| 4,830,280 | 5/1989 | Yankoff . | |
| 4,836,455 | 6/1989 | Munoz . | |
| 4,854,770 | 8/1989 | Puchala et al. . | |
| 4,878,785 | 11/1989 | Heron et al. . | |
| 4,893,754 | 1/1990 | Ruiz . | |
| 4,911,188 | 3/1990 | Seidel | 134/56 R |
| 4,923,120 | 5/1990 | Hammelmann . | |
| 4,951,429 | 8/1990 | Hashish et al. . | |
| 5,034,066 | 7/1991 | Imhof et al. . | |
| 5,052,423 | 10/1991 | Chapman et al. . | |
| 5,092,961 | 3/1992 | Keller . | |

*Primary Examiner*—Frankie L. Stinson
*Attorney, Agent, or Firm*—Pollock, Vande Sande & Priddy

[57] ABSTRACT

An apparatus and method for removing a coating of undesirable material from a substrate of desired material by impacting the coating with narrowly focused streams of fluid discharged at high velocity from nozzle tips rotated rapidly by a nozzle head during linear, relative movement between the nozzle head and the coated substrate. The nozzle head may be rotated by a motor or self-actuated by tilting the tips out of the plane of the spin axis. The nozzle tips also may be canted radially to undercut and peel away the coating. The nozzle assembly may be continuously or intermittently actuated, fixedly or movably mounted, and used singularly or in plural array. Specific applications are described for descaling metal, cleaning electrolytic bath deposits from electrodes, and removing resinous materials from metal surfaces.

30 Claims, 16 Drawing Sheets

20
22
24
26
28
30
32
33
34
36
38
40
42
44
46
48
50
51
52
54
56
57
58
60
61
61a
62
62a
64
66
69
70
73
74
76
77
78
82
84
85
86
87
88
90
92
98
99
100
102
103
104
106
107
110
112
114a
114b
115a
115b
116
117
118
120
122
123
124
125
126
128
129
130
140
141
142
146
148
150
152
153
154
155
156
157
158
159
160
161
162
163
200
250
95

FIG. 6
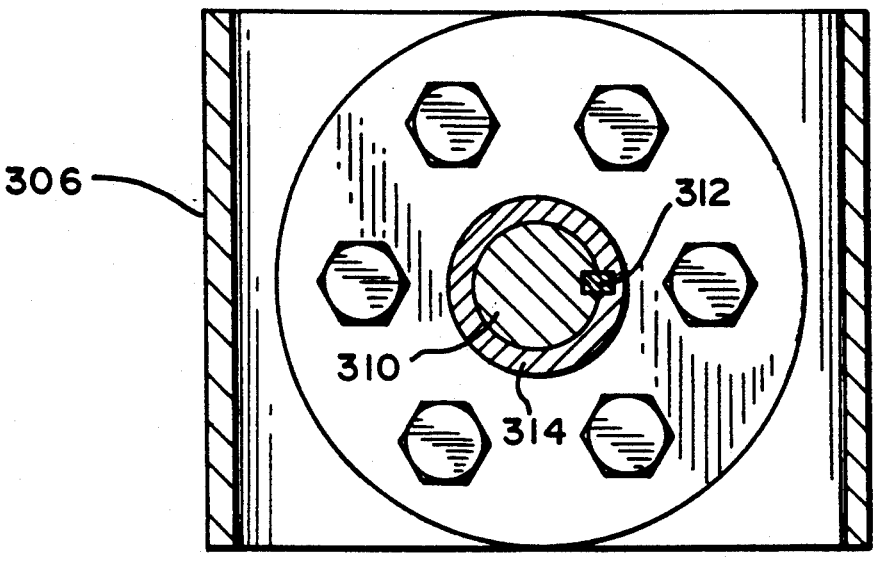
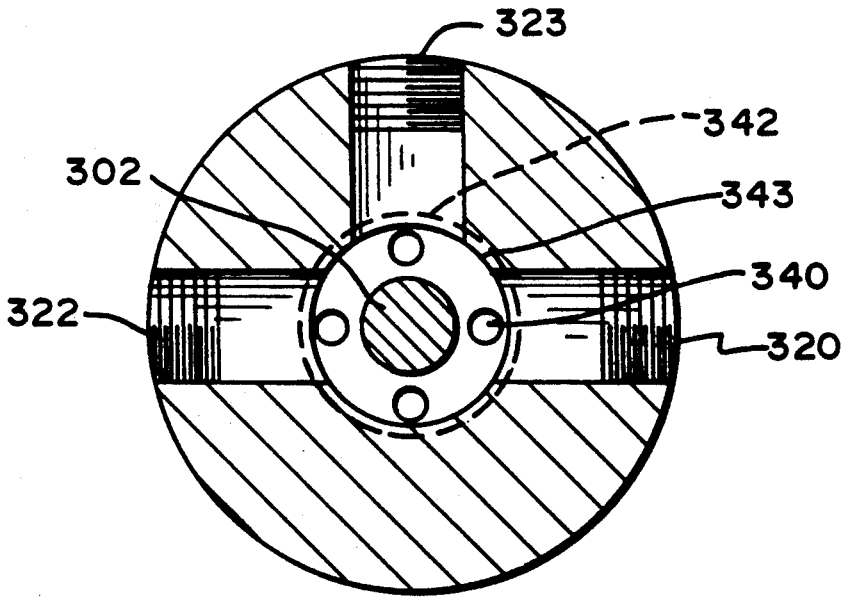
FIG. 7

FIG_10
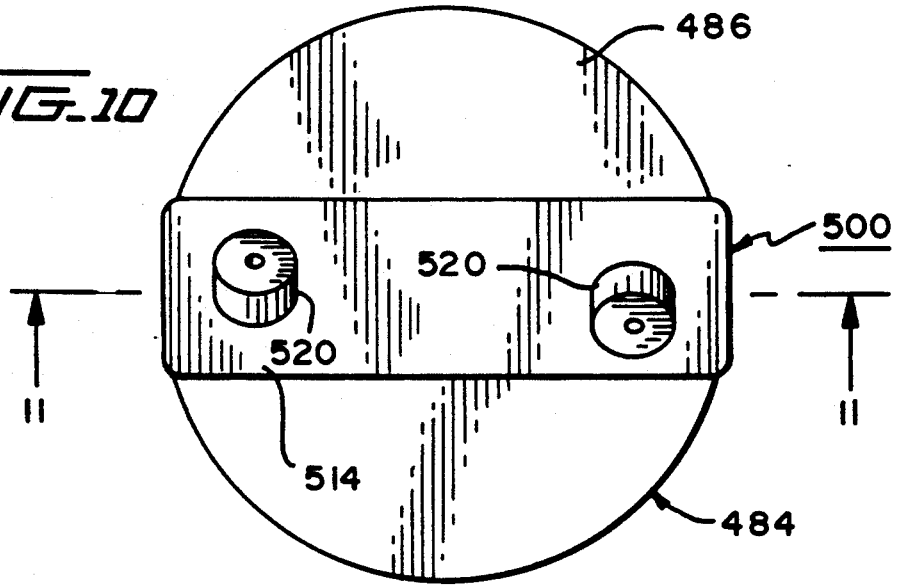
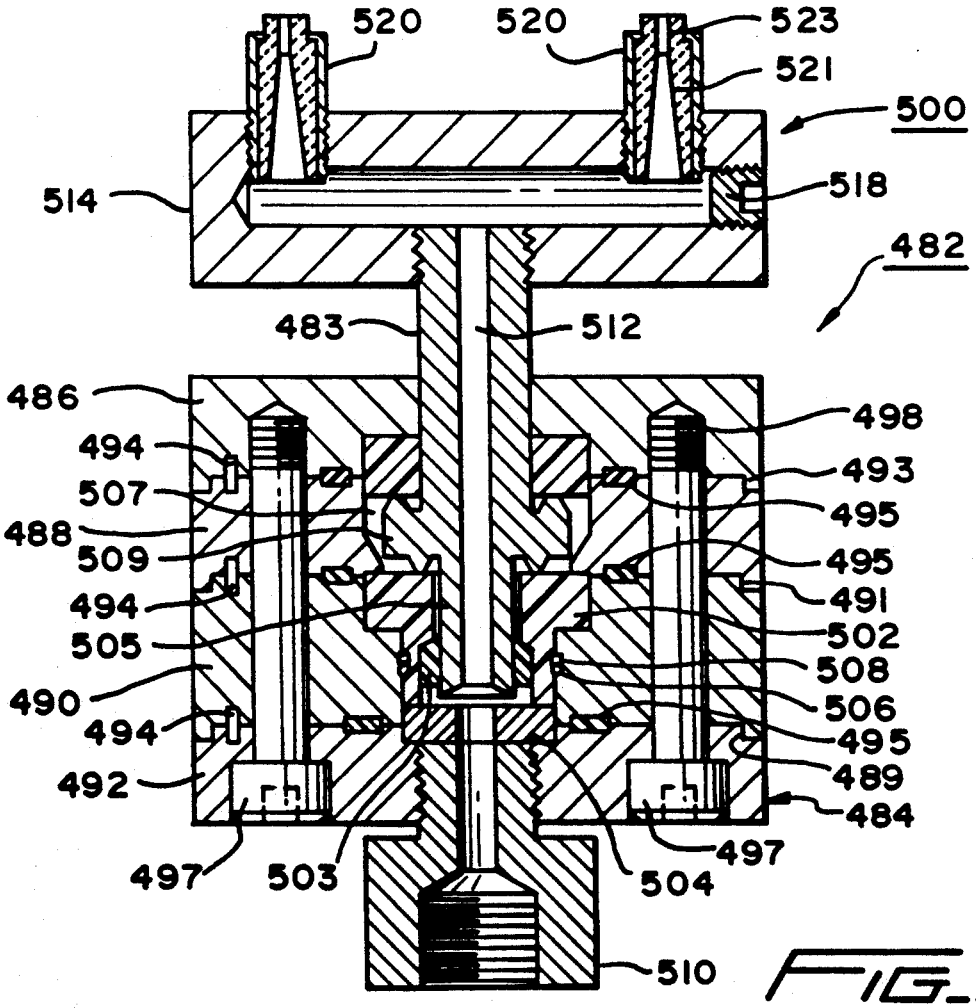
FIG_11

APPARATUS AND METHOD FOR CLEANING WITH A FOCUSED FLUID STREAM

TECHNICAL FIELD

The present invention relates to apparatuses and methods for cleaning with a high pressure fluid, and more particularly to apparatuses and methods using a focused stream of liquid or gas discharged from a nozzle to remove an outer layer of undesirable material from a base or substrate of desired material.

BACKGROUND OF THE INVENTION

High pressure water has been used in the past for cleaning an undesirable layer of material from a base or substrate of desired material. For example, in recent years, the descaling of hot steel billets in rolling mills has become a necessity because it improves the quality of the final steel products, and such higher quality has become necessary for these products to be competitive in international markets. For this purpose, many steel rolling mills in the United States now discharge relatively large volumes of water against the hot steel billets in order to use thermal shock to remove scale from billet surfaces before the billets are shaped.

In one such application, a rolling mill has used two large high-pressure pumps and an array of eight fan jet nozzles mounted to provide a spray ring for covering all sides of a hot billet moving through the ring. Such fan jet nozzles provide a coreless spray having a wide fan-like shape which diverges at an angle in the range of about 15° to about 40° as measured from side to side in the plane of the "fan". Water was delivered to the spray ring at a pressure of about 1800 psi, and was discharged at the rate of about 100 gallons per minute. In addition to such high water usage at relatively low pressures, fan jet nozzles have another disadvantage in that their diverging spray causes the water to lose its energy rapidly, so that by the time the water hits the surface to be cleaned, it does not have sufficient energy to knock off the scale by impact. Fan jet nozzles therefore rely on thermal shock principles to remove the scale rather than the impact energy of high-velocity water streams.

Fan jet water sprays also have been used to clean dried resin-impregnated fibrous material from the perforated steel drums and calendar rolls of dryers used in processing continuous webs of fleece-like materials, such as those dryers manufactured by the Fleissner Company of Germany and used in the manufacture of carpeting. In one such application, the water pressure was raised to 36,000 psi in an effort to get sufficient water impact to remove the dried resinous coatings from the perforated steel drums. Although this water cleaning effort was successful, it required very large volumes of water and was extremely slow. For example, 12–18 hours were required to clean the two drums of a single dryer at a cost of about $400 per hour. The significant variation in hours required was due to differences in the depths of the coatings allowed to accumulate on the drums before they were cleaned.

Instead of water cleaning with fan jets, mechanical cleaning methods also have been used in the past to remove an outer layer of undesirable material from a base or substrate of desired material. One such mechanical cleaning method has been used to clean deposits of electrolytic baths from spent anodes used in the metal refining industry. For example, one plant for refining aluminum has used rotary blast wheels employing centrifugal force to throw steel shot against the bath coating on the carbon body of the anodes after they were dried. By abrading the dry bath coating, the steel shot created a large volume of dust which had to be collected by means of a dust collector and bagged in 1,000 pound bags for disposal in a landfill. Thus, the aluminum refining plant generated 16 tons of dust per week, which cost about $300 per week merely to haul to a landfill. Moreover, 16 dust bags at a cost of about $320, and about 1 ton of steel shot at a cost of about $400, were expended each week. Such abrasive cleaning systems also are labor intensive, and involve high maintenance costs. The yearly maintenance on the shot blasting machines at the aluminum refining plant was over $20,000. Workers in the area also had to be protected against the dust such that such abrasive cleaning techniques are not environmentally friendly.

Mechanical abrading methods have also been used for cleaning Fleissner dryers of the type mentioned above. In one plant, a sandblasting and vacuuming machine was used to traverse the drums, but proved to be too slow and after several cleanings, the drums had to be removed and either resurfaced or replaced at a cost of about $35,000 per drum. Sandblasting also involves a dusty environment in which the workmen must wear breathing masks. In addition, sand and other abrasive particles can get into the moving parts of machinery and cause these parts to wear more quickly.

The cleaning of Fleissner dryers also has been carried out in at least one plant by hand by putting several workmen with breathing masks inside each dryer and having them use electric wire brushes and abrasive pads. This method took four men three days to clean the surfaces of the two drums of a single dryer, and the holes through these surfaces could only be partially cleaned. Therefore, when the dryer was put back in operation, air would not pass as efficiently through the partially clogged holes, and this significantly slowed down the rate of production in this plant.

For many cleaning situations, it has been considered impractical in the past to use pressurized air to remove a moderately adhered layer or coating of undesirable material, such as bath deposits, from a substrate of desired material, such as a carbon anode.

DISCLOSURE OF THE INVENTION

The present invention overcomes the foregoing deficiencies of the prior art. It is therefore a principal object of the invention to provide a cleaning system which uses a high pressure fluid more effectively, efficiently and economically than high pressure fluid cleaning systems of the prior art.

Another object of the invention is to provide a cleaning system which uses the impact energy of a high pressure fluid instead of that of solid abrasives, and thereby avoids the abrasive environment and the accumulation of solid wastes associated with solid abrasives.

Yet another object of the invention is to provide apparatuses and methods for removing a wide variety of outer coatings or layers of undesirable materials from a wide variety of bases or substrates using a high pressure fluid in a physically safe and environmentally friendly manner.

A further object of the present invention to rapidly remove an outer layer of undesirable material from a base or substrate of a desired material using a high velocity fluid stream in an efficient, economical and environmentally safe manner. For example, focused water streams provided by a nozzle made and applied in accordance with the present invention cleaned the outside surface and all the holes of the two drums in a Fleissner dryer in only 1½ hours without creating environmentally hazardous dust.

A still further object of the invention is to provide a system for cleaning with high pressure water which utilizes much less water than water cleaning systems of the prior art.

The present invention achieves the foregoing objects by utilizing the impact energy of one or more highly focused streams of fluid each discharged at high velocity from a nozzle tip which passes the fluid at a relatively high pressure but relatively low flow rate and is mounted on a nozzle head that is rotated rapidly to give the necessary area of coverage. The fluid may be a liquid or gas depending on the application. Although this specification by way of example refers specifically to water as the liquid fluid and air as the gaseous fluid, other liquids and gases may be used and are within the scope of the invention.

The focused nozzle tips used in the present invention preferably also have a specific bore structure to maximize the distance over which the stream of the ejected fluid, preferably water or air, stays highly focused in a narrow core to minimize the decrease in the average velocity of the ejected fluid mass prior to impact. This bore structure includes an upstream section with a taper converging toward the bore axis, followed by a straight section parallel to the bore axis and ending at the orifice opening. The surface of the converging section preferably defines a right circular cone. The surface of the straight section preferably defines a right cylinder of substantially uniform diameter, although other cylindrical shapes of substantially uniform cross section, e.g. oval, may be used. In the focused nozzle tips of the invention, the angle of taper between the bore axis and the tapered wall of the tapered bore section is preferably greater than 5°, more preferably in the range of about 5° to 30°, and most preferably in the range of about 15° to 25°. However, the category of nozzle tips designated in the art as "zero degree", which may have tapered bores converging at angles outside of these preferred ranges, may be employed, where modified to make the ejected fluid stream sufficiently focused to meet the other criteria specified herein.

Other important parameters of the nozzle tip bore structure for maximizing the distance over which the ejected streams stays highly focused include the ratio of the tapered bore length to the straight bore length (tapered to straight length ratio), and the ratio of the straight bore length to the maximum dimension of the straight bore orifice opening (straight length to orifice size ratio). In this regard, the tapered to straight length ratio is preferably in the range of about 1.0 to 20.0 more preferably about 2.5 to 10.0, and most preferably about 3.0 to 8.0 and the straight length to orifice size ratio is in the range of about 0.5 to 10.0 more preferably about 1.0 to 4.0, and most preferably about 1.25 to 3.0.

For a predetermined fluid operating pressure, the straight section of the nozzle tip bore, which also is referred to herein as the "orifice", has a discharge opening that is sized relative to the distance between this opening and the surface of the substrate to be cleaned so as to provide a fluid impact velocity at the substrate surface sufficient to remove at least 50%, preferably at least 80%, more preferably at least 90%, and most preferably substantially all of the coating material within the cleaning pattern provided by a single pass of one nozzle tip. However, in applications requiring greater spacing between the tip orifice and the substrate surface or involving tenaciously adhered coatings, the cleaning action provided by multiple passes of one or more nozzle tips may be required to achieve the above degrees of coating removal.

Because of the significance of the length of the straight bore relative to the length of the tapered bore, small adjustments may be critical to providing an ejected fluid stream in its most highly focused condition. For example, an adjustment over the range of 5 to 80 mils in the length of the straight bore relative to the tapered bore may result in first increasing and then decreasing the focus. Thus, variations in length of the straight bore by a few mils relative to the length of the tapered bore may substantially affect the angle of divergence of the core of an ejected fluid stream. One way to achieve maximum focus is to make the straight bore slightly longer than needed and then adjust this length by grinding away the outer end of the nozzle tip until focusing of the ejected fluid stream is maximized. Another feature for maximizing the focus of the ejected fluid stream is to insure that both the tapered bore and the straight bore of the nozzle tip are maintained in a highly polished condition to provide the bore surfaces with a mirror-like finish.

Since the fluid streams employed by the invention are focused so narrowly, a plurality of nozzle tips, preferably at least two, are mounted in laterally spaced relation on a nozzle head and the head is rotated rapidly in order to obtain complete coverage of the surface to be cleaned as the workpiece and the nozzle head are moved relative to each other. The spinning head thereby provides a fluid or cleaning pattern which may be viewed as a hollow cylinder or a hollow cone, depending on whether the nozzle tips are parallel to the spin axis or are canted radially outward from the spin axis. The cleaning pattern of the spinning nozzle head is defined by the walls of these hollow geometric figures, the periphery of which is circular and the thicknesses of which correspond to the diameter or major transverse dimension of the substantially solid core of the fluid stream as measured in a plane perpendicular to the spin axis. When the nozzle body is stationary relative to the surface of the workpiece substrate, the cleaning pattern of the ejected fluid produces a cleaned annular band from which the workpiece coating has been removed. When relative movement between the nozzle and the workpiece is such that the spinning nozzle head moves in a direction perpendicular to the spin axis and parallel to the substrate surface, the fluid cleaning pattern cuts a linear path through the coating material and removes this material to produce a cleaned path along the substrate surface, the width of this linear path being equal to the diameter of the circular cleaning pattern.

In view of the foregoing, the ability of the cleaning pattern to provide 100% coverage of a workpiece surface to be cleaned depends upon the rate at which the nozzle head is spun relative to the rate of linear relative movement between the nozzle head and the workpiece surface. For purposes of spinning the nozzle head, some type of motor may be used, such as one powered by electricity, air or a combustion engine, or the nozzle head may be self-actuated by tilting the nozzle tips relative to the spin axis in a plane parallel thereto. The nozzle head may be rotated in either direction and the rate at which the nozzle head is spun also may be variable, such as where the power source is a direct current (DC) electric motor or a variable gearing system is provided between the motor and the nozzle head.

The preferred speed range of the nozzle head of the present invention is from 5000 to 2,000 rpm. The rate of spin selected for the nozzle head is based upon achieving 100% coverage with the core diameter available at stream impact against the workpiece, which in turn depends on the speed of the workpiece surface relative to the spin axis of the nozzle. For example, where the impact diameter of the stream core is 0.1 inches, the workpiece should not advance faster than 0.2 inches per revolution of a spinning nozzle head with two tips in order to insure complete coverage at both the leading and trailing edges of the cleaning pattern at impact. However, a workpiece moving up to twice as fast (e.g. 0.4 inches per nozzle head revolution) may be cleaned satisfactorily because the trailing edge of the cleaning pattern will often provide sufficient coverage to clean those areas missed by the leading edge of the cleaning pattern.

The overall width of the straight path that is cleaned by lateral movement of the cleaning pattern depends of course on the lateral spacing of the nozzle tips on the spinning nozzle head, as well as whether those tips are directed parallel to the spin axis or are canted radially outward relative to the spin axis. For motor-actuated spinning heads, the nozzle tips are preferably canted outward radially to take advantage of the wider area of coverage provided by the hollow cone cleaning pattern, while adequately preserving impact velocitles. Cant angles in the range of 5° to 85°, preferably 10° to 80°, more preferably 30° to 60°, and most preferably 40° to 50° also have been found to be effective in getting between coatings of metal scale or bath deposits and the underlying substrate so as to cause a dislodgement of the coating in a peeling type action. It is also to be noted here that a 45° slant of the fluid stream significantly increases the width of the annular band impacted by this stream at each pass of the tip by about 41%, i.e., the same percentage by which the length of the hypotenuse exceeds the length of the other two sides of an isosceles right triangle. The coverage provided by lateral spacings of 3 to 5 inches between the axis of nozzle orifice openings has been found to be satisfactory for these applications.

Because the nozzle tips of a self-actuated spinning head are already canted relative to the spin axis to provide the tangential forces for spinning the head, it is preferable that these tips not also be canted radially outward. Accordingly, the self-actuated spinning head may provide a hollow cylindrical cleaning pattern. The angle of tilt of these nozzle tips out of an axial plane of the spin axis (as different from a radial cant within an axial plane of the spin axis) is selected in combination with the lateral spacing of the tips to provide the desired rate of spin of the nozzle head. For example, two nozzle tips on a self spinning head with their orifice axes spaced 1½ inches to either side of the spin axis and tilted at an angle of about 10° relative to the spin axis will cause the head to spin at about 5,000 rpm where the diameter of the nozzle tip opening is about 50 mils and the fluid is water at a pressure of about 12,000 psi. To insure an adequate rate of spin and level of water impact, the angle of tilt of the nozzle tips relative to the spin axis is preferably in the range of about 5° to 20°, more preferably 10 ° to 15°, for water pressures in the range of 8,000 to 15,000 psi, and with an appropriate selection of orifice size and lateral" spacing of the nozzle tips to provide the desired rate of spin.

The nozzle tip preferably used for discharging water focuses the water stream so that it does not mix with a substantial amount of air and therefore remains a substantially solid stream of water between the discharge opening of the tip orifice and the point at which this stream impacts against the surface of a workpiece. The solidarity of the ejected water stream may be determined by the proportion of ejected water remaining in its core portion and by the angle of divergence of this core portion as measured from one side of the stream to the other at a predetermined distance from the orifice opening. The core portion of a focused stream of water at 6 inches from the orifice opening contains at least 50%, preferably more than 80%, more preferably more than 90% and most preferably more than 95%, by weight of the ejected water leaving the orifice opening. A core portion containing at least 90% of the ejected water within a core diverging at no more than 5° at 6 inches from the orifice opening is considered to provide a substantially solid water stream.

For the water nozzle of the present invention, at 6 inches from the orifice opening, the angle of core divergence is preferably no more than 5°, more preferably no more than 3°, and most preferably no more than 2°. For purposes of this specification, a "focused" water nozzle tip is one wherein the angle of divergence of the ejected stream core from side to side at 6 inches from the nozzle orifice opening is not more than 5°. Focused water nozzle tips may include what are known in the art as "zero degree" nozzle tips, provided that the zero degree tip is modified to give an angle of core divergence from side to side which is not more than 5° at 6 inches from the nozzle orifice opening. Zero degree nozzle tips generally have tapered bore sections converging at angles greater than 30° upstream of the straight section. Highly focused tips providing less than a 3° divergence, more preferably less than a 1.5° divergence, of the high velocity water stream core at 6 inches from the orifice opening are the most effective in many applications of the present invention.

The solidarity of the ejected also may be determined by the multiplier by which its core expands over a predetermined distance from the orifice opening of the nozzle tip. An increase in core diameter by a factor of 5 (five fold) at 6 inches from the orifice opening is roughly equivalent to a divergence angle of 3° over the same distance. The "zero degree" nozzle tips for use with the present invention preferably limit expansion of the water stream core to a twelve fold increase, whereas the highly focused nozzle tips for use with the present invention more preferably limit the increase in core diameter to three fold or less, most preferably 2.5 fold or less, all as taken at 6 inches from the orifice opening. Thus, a highly focused nozzle tip with an orifice opening of 0.041 inches in diameter most preferably will yield a water stream core that is about 0.1 inches or less in diameter at 6 inches from the orifice opening.

As previously indicated, the focused nozzle tips of the invention have a conical section upstream of a straight section, and the relative lengths of these sections and the size of the orifice opening are of particular importance. In the water nozzle tips of the invention, the tapered to straight length ratio is preferably in the range of 1.5 to 10.0, more preferably 3.0 and 8.0, and most preferably 3.3 to 7.5; and the straight length to orifice size ratio is preferably 0.75 to 5.0, more preferably 1.0 to 4.0, and most preferably 1.25 to 3.0.

For the water applications described hereinbelow, the diameter of the orifice opening is preferably in the range of about 40 mils to 70 mils. For an opening diameter of 40 mils, the tapered bore is preferably about 0.125 inches in length and the straight bore is about 0.75 inches in length; and for an opening diameter of about 70 mils, the tapered bore is about 1.0 inches in length and the straight bore is about 0.25 inches in length. At about 12,000 psi water pressure, the 40 mil opening provides a water velocity of about 1,300 ft/sec, and the 70 mil opening provides a water velocity also of about 1,300 ft/sec at the orifice opening but req moore AP. The distance between the orifice opening and the surface of the substrate to be cleaned is preferably such that the water velocity at impact is sufficient to remove at least a majority of the coating material within the cleaning pattern provided by a single pass of one nozzle tip. To accomplish this, the discharge velocity at the orifice opening is preferably at least about 900 ft/sec, more preferably at least about 1,100 ft/sec and most preferably at least about 1,500 ft/sec. In applications other than those described herein, higher impact velocities may be desirable and may be achieved by increasing the water pressure, for example up to about 50,000 psi, and by sizing the orifice bore to provide a higher discharge velocity, for example up to about 3,000 ft/sec.

The invention also involves matching a focused, water nozzle tip on a spinning nozzle head with a high pressure water pump. Important characteristics of the high pressure water pump include its capacity and horsepower, which are closely related to the flow rate and pressure at which water is ejected through each nozzle tip. Thus, the higher the tip flow rate at a given pressure, the higher must be the flow rate and the horsepower of the pump to sustain the given pressure. On the other hand, a pump of given horsepower can achieve higher pressures at lower tip flow rates.

At water pressures above about 6,000 psi, the water nozzle tips employed by the invention will produce a narrow, substantially solid water stream capable of quickly cutting through a wood 2×4 or the like placed at about 10 inches from the orifice opening. For this reason, the water nozzle heads of the invention are sometimes referred to in this specification as "cutting heads" for providing a "cutting patterns of water capable of cutting through the coating on a substrate. For many cleaning operations using the invention, a water pressure in the range of 8,000–15,000 psi, more preferably 11,000–13,000 psi, and most preferably about 12,000 psi has been found to provide particularly effective cutting patterns. With these patterns, different flow rates have been found to be effective for different applications, primarily because different applications require that the nozzle tips be at different distances from the workpiece for optimal performance, depending on the workpiece environment.

The carbon body of anodes used in the metal refining industry serves as a substrate on which electrolytic bath materials are deposited as a "bath" coating. The present invention is especially effective in removing this undesirable coating. Because the thickness of bath deposits on carbon anodes may vary considerably, the water nozzle tips for removing such deposits are preferably spaced an average distance of about 10 inches from the carbon surface. This distance minimizes cutting away of the carbon itself while effectively removing the bath coating, even where it has been vitrified by the heat of the metal refining process. For two nozzles, one opposite each elongated side of the anode, and each nozzle employing two nozzle tips, the nozzle tips are preferably selected to provide a flow rate of 2.5 gallons per minute (gpm) each, for a total cleaning system flow rate of 10 gpm, which in turn requires a high pressure pump with a motor of about 100 horsepower (hp) in order to achieve a nominal operating pressure of 12,000 psi.

In a system for cleaning scale from steel billets, the water nozzle tips are preferably located an average distance of about 3 inches from the surface of the billet being cleaned because of known variations in the size of the billets and in the positioning of the billets on the conveyor carrying them past the cleaning nozzles. In this system, four nozzles may be arranged in an array around the conveyor so as to cover all sides of the billets and the spinning head of each nozzle carries two nozzle tips, for a total of eight nozzle tips. To achieve a nominal operating pressure of about 12,000 psi, this cleaning system employs two high pressure pumps, each having a capacity of about 23 gpm, such that the flow rate through each nozzle tip is about 5.75 gpm, which in turn requires that each high pressure pump be powered by a motor preferably rated at about 150 hp.

In a system for cleaning resin-impregnated fibrous material from the drums of a Fleissner dryer, the water nozzle tips may be placed relatively close (preferably about 1.5 inches) from the surface of the rotating drum because both the surface of the drum and the head of the water nozzle moving opposite thereto are held in very precise, fixed positions. Only one nozzle with two nozzle tips on a self-spinning head may be needed in this system, and the flow rate through each nozzle tip is preferably about 5 gpm as delivered at a nominal pressure of about 12,000 psi by a pump having a motor preferably rated at 75 hp. However, in this latter application of the invention, the required flow rate through the nozzle tips is greatly dependent upon the thickness of the coating to be removed from the drums which, in turn, depends on the frequency with which the drums are cleaned. Accordingly, smaller capacity nozzle tips and smaller pumping requirements may be used in combination with frequent (e.g., weekly) cleaning of the drums. For such frequent cleaning of the drums, it is believed that a 20 hp pump delivering about 1.0 to 1.5 gpm through each nozzle tip at a nominal pressure of 12,000 psi will be satisfactory. Similar reductions in the nozzle tip flow rates and pumping capacities also are possible in the anode cleaning system where the thickness of the layer of bath deposit is reduced by a precleaning operation, such as by an air nozzle having a spinning head capable of removing non-vitrified bath deposits as described below.

Many of the foregoing objects of the invention also may be achieved by utilizing the impact energy of one or more highly focused streams of a gas, such as air. Thus, in many instances, an air nozzle having one or more focused air tips may be used in a cleaning operation in place of the water nozzles described above. Many of the air nozzle features, such as the angle of the nozzle tips and the positioning of the nozzle bodies are the same as or similar to the water nozzle features. However, other features, such as bore diameters, rates of head spin, shaft seals, air suction apertures and system flow capacities, are designed specifically for a gaseous medium instead of a liquid medium, the latter being substantially incompressible relative to the former. In this specification, although water and air are referred to specifically, the invention contemplates the use of other liquids instead of water and the use of other gases instead of air.

The air nozzles, similar to the water nozzles, use one or more "focused" nozzle tips. However, since the air diverges much more rapidly than water upon leaving the tip orifice, the parameters of a "focused air" nozzle tip differ from those of a "focused water" nozzle tip. The air nozzle tip used preferably focuses the ejected air stream so that its core retains a major portion of the energy, i.e., a major portion of the mass and velocity of the ejected stream, between the discharge opening of the tip orifice and the point at which this stream impacts against the surface of a workpiece. Dissipation of the impact energy of the ejected air stream may be determined by the decrease in both the mass and velocity of its core at a predetermined distance from the orifice opening. For purposes of this specification, a "focused air" nozzle tip is one wherein the core of the air stream at 6 inches from the orifice opening contains preferably 50% by weight of the ejected air mass, more preferably 70% of the ejected air mass, and most preferably 80% of the ejected air mass; and the loss in velocity of this core at 6 inches from the orifice opening is preferably not more than 30%, more preferably not more than 20%, and most preferably not more than 10%.

The solidarity of the ejected air stream may be determined by the proportion of the air mass remaining in its core portion and by the angle of divergence of this core portion as measured from one side of the stream to the other at a predetermined distance from the orifice opening. The core portion of a focused stream of air at 6 inches from the orifice opening contains at least 50%, preferably more than 60%, more preferably more than 70% and most preferably more than 80%, by weight of the mass of air leaving the orifice opening. A core portion containing at least 70% of the ejected air mass within a core diverging at no more than 6° at 6 inches from the orifice opening is considered to provide a substantially solid air stream. The angle of divergence provided by a focused air nozzle tip may be determined by injecting a colored gas into either the primary or secondary air fed to such tips.

The ability of the ejected air stream to retain its impact energy also may be determined by the multiplier by which the mass of air remaining in the core of this stream expands over a predetermined distance from the orifice opening of the air nozzle tip. Thus, the focused air nozzle tips of the invention limit the increase in diameter of the core (as defined above) of the ejected air stream at 6 inches from the orifice opening to less than a factor of 12 (12 fold), preferably less than a factor of 10 (10 fold), more preferably less than a factor of 8 (8 fold), and most preferably less than a factor of 5 (5 fold). In order to achieve such highly focused air streams, the bore of the air nozzle tips of the invention have a tapered length to straight length ratio preferably in the range of about 1.25 to 16.0 more preferably about 2.5 to 7.0, and most preferably about 3.0 to 4.0; and a straight length to orifice size ratio in the range preferably of about 0.5 to 10.0, more preferably of about 1.5 to 3.0, and most preferably about 2.0 to 2.5.

Since the air streams employed by the invention are focused so narrowly, a plurality of nozzle tips, preferably two, are mounted in laterally spaced relation on a nozzle head and the head is rapidly spun in order to obtain complete coverage of the surface to be cleaned as the workpiece and the nozzle head are moved relative to each other. Thus, the cleaning pattern and the linear cleaning path provided by the focused air nozzle tips and spinning head are determined in the same manner as for the water nozzle described above so that the description thereof is not repeated here. However, special considerations are involved in matching a focused air nozzle tip on a spinning nozzle head with a source of high pressure air. Important characteristics of the high pressure air source include its flow capacity at a given pressure, which is closely related to the flow rate and pressure at which air is ejected through each nozzle tip. In this regard, the storage capacity of the high pressure air reservoir is preferably relatively large such that intermittent discharges of high pressure air will not significantly change the pressure at which air is supplied to the air nozzles, and this pressure can be maintained relatively easily by intermittent operation of an air compressor attached to this storage reservoir.

In a system for removing bath deposits from carbon anodes, it has been found in many cases that the air nozzle of the invention is alone sufficient to remove these deposits without the need for a subsequent cleaning step with a water nozzle having a cutting head of the type described above. In these applications, the air pressure is preferably in the range of 90 to 500 psi, more preferably 110 to 300 psi, most preferably about 150 psi, with the nozzle tip orifice preferably spaced an average distance of about ten (10) inches from the carbon anode surface. For an air pressure of about 150 psi, the air nozzle tip orifice is preferably sized relative to the distance between its opening and the surface of the substrate to be cleaned so as to provide an impact velocity at the substrate surface sufficient to remove at least a majority of the bath deposits within the cleaning pattern provided by a single pass of the nozzle tip. To accomplish this, the air velocity at the orifice opening is at least about 600 ft/sec, more preferably at least about 800 ft/sec, and most preferably at least about 1,100 ft/sec. In other applications, higher discharge velocities may be desirable and may be obtained by increasing the air pressure, for example, up to 5,000 psi or more. However, the higher the pressure, the more costly the air compressing equipment.

The air nozzle tips also have the feature wherein a straight bore immediately upstream of the orifice opening is preceded by a tapered bore in order to minimize stream turbulence and to keep the ejected air stream highly focused until impact. By way of example, air orifice diameters preferably are in the range of 100 to 500 mils. For an orifice diameter of 100 mils, a tapered bore about 1.25 inches in length and a straight bore about 0.25 inches in length are preferred. For an orifice diameter of 250 mils, a tapered bore about 2.5 inches in length and a straight bore about ½ inch in length are preferred. For an orifice diameter of 500 mils, a tapered bore about 4 inches in length and a straight bore about 1 inch in length are preferred. As with the water nozzle tips, it is best to first select the orifice diameter and the tapered bore length, and to then adjust the straight bore length (starting at about the above specified nominal lengths) by grinding off the outer end of the tip until maximum focus of the air stream is achieved.

BRIEF DESCRIPTION OF THE DRAWINGS

The structure, operation and utility of the invention may be better understood from the Detailed Description below taken in conjunction with the attached drawings, in which:

FIGS. 2, 3A and 3B are schematic diagrams of the electrical systems for operating the fluid systems and individual components of the invention;

FIG. 6 is a sectional view of the high pressure diverter valve taken along line 6—6 of FIG. 4;

FIG. 7 is a sectional view of the high pressure water diverter valve taken along line 7—7 of FIG. 4;

FIG. 10 is a front end view of the self-actuated high pressure water nozzle in accordance with the invention;

FIG. 11 is a sectional view of the self-actuated high pressure water nozzle taken along line 11—11 of FIG. 10;

FIG. 13 is a front elevational view in partial section of the electrode of FIG. 12 being cleaned by two motorized high pressure water nozzles in accordance with the invention;

DETAILED DESCRIPTION

Fluid Operating Systems

Figure 1:
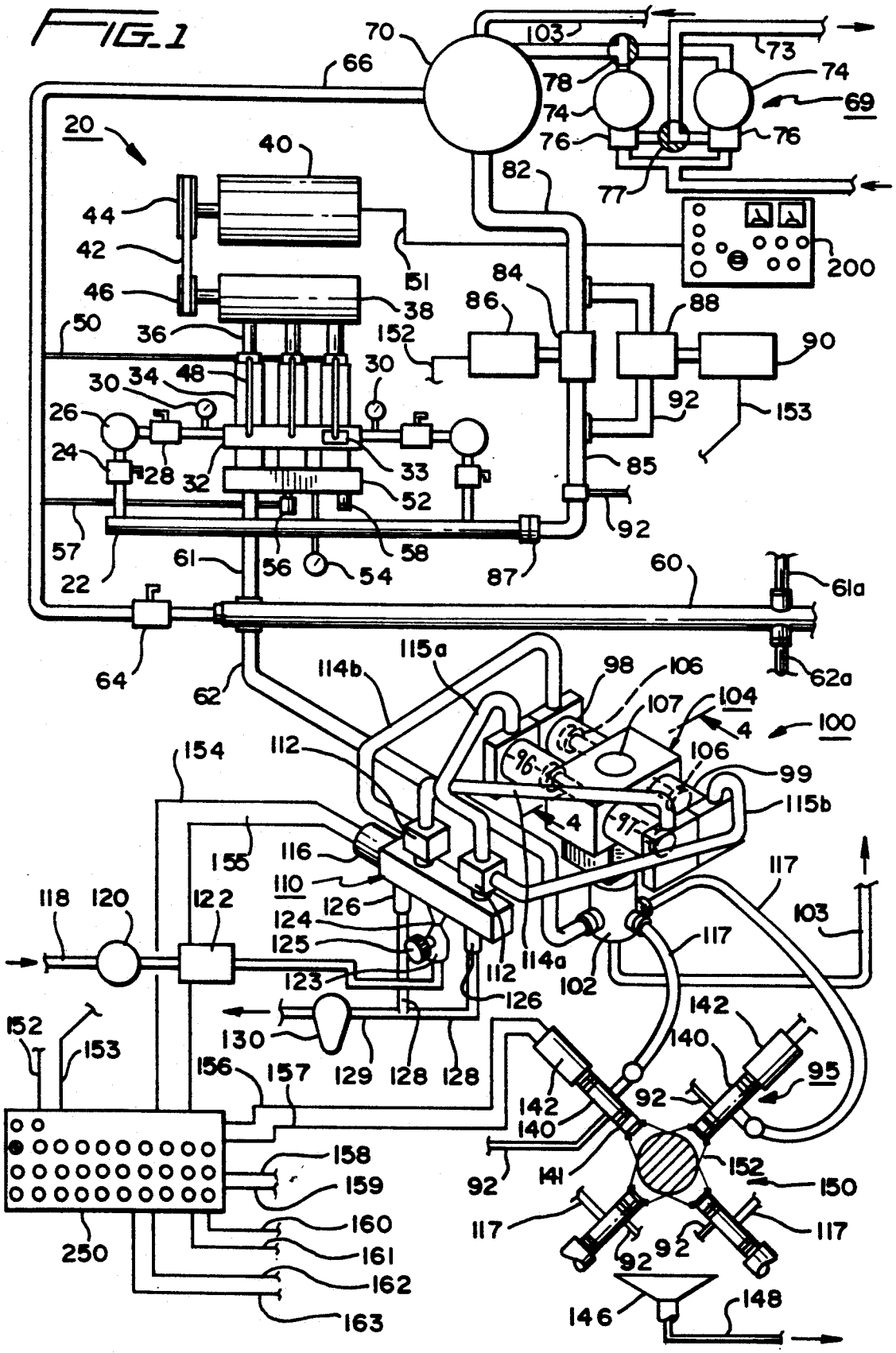
FIG. 1 is a schematic diagram of the liquid and gaseous fluid systems of the invention.

The fluid systems of the invention for operating the high pressure water nozzles of the invention are illustrated diagrammatically in FIG. 1. A high pressure, positive displacement water pump 20 receives water through a low pressure feed water distributor 22. High pressure pump 20 is preferably a GA Series Triplex Plunger Pump, such as available from Aqua-dyne, Inc., of Houston, Tex. Such pumps employ high precision internal components requiring that the feed water be substantially free of debris and of relatively high purity. The feed water therefore passes through a pair of final filters 26,26 upstream of an inlet header 32 of pump 20.

Isolation valves 24,24 and 28,28 are provided on either side of final filters 26,26 in order that one of these filters may continue to operate while the other filter is isolated for filter replacement. Also upstream of inlet header 32 are pressure gauges 30,30 for indicating feed water pressure. A low inlet water pressure sensor 33 is provided on inlet header 32 and connected to circuitry for de-energizing pump motor 40 in response to low feed water pressure, such as less than 50 psi.

High pressure pump 20 has three (3) cylinders 34 each with a piston (not shown) driven by a corresponding piston rod 36 which is connected to a driven pulley 46 by a crank shaft (not shown) in crank case 38. Driven pulley 46 is engaged by a drive belt 42 so as to be driven by the electric motor 40 through a driving pulley 44. Belt 42 is preferably of the positive drive type wherein cogs on the inside of the belt are engaged by corresponding recesses in each of the pulleys 44 and 46. Motor 40 may be of either the alternating current (AC) or direct current (DC) type, the latter providing the option of variable speed to permit varying the output pressure of the pump for a given size of nozzle orifice, and thereby varying the velocity of the water stream discharged by this orifice. The size ratio between driving pulley 44 and driven pulley 46 is such the pump crank shaft is driven at about 540 rpm where motor 40 is an AC motor operating at 1800 rpm. By way of example, such a motor rated at 150 horsepower in combination with a 23 gpm pump of the above type is capable of generating water pressures of up to 22,500 psi, but is preferably operated with nozzle orifices of a size and number so as to provide water discharge pressures in the range of 8,000 to 15,000 psi, more preferably in the range of 10,000 to 14,000 psi, most preferably about 12,000 psi.

The cylinders 34 of pump 20 are preferably cooled by feed water fed from inlet header 32 through lines 34 to the piston rod seals at the rear of each cylinder. After passing through cooling passages within the pump, the cooling water is discharged through a line 50 and recycled via a conduit 66 to a water feed tank 70, which may be portable along with the entire system shown in FIG. 1.

Feed water may be provided by connecting inlet header 32 to a city water supply system. However, a self-contained portable system may utilize the tank 70 as a holding tank which may be supplied with water from any natural source or industrial supply via a bulk filtration system, generally designated 69. A water transfer pump (not shown) draws water from a storage facility, a separating pond or the like and supplies this water to filtration system 69 through a supply conduit 72. The filtration system preferably includes dual filters 74,74 so that one of these filters may be taken out of service and cleaned by backwashing the removed solids through a return conduit 73. Inlet distributors 76,76 and 3-way valves 77 and 78 provide appropriate flow paths for having one filter on line while the other is being backwashed.

Feed water from holding tank 70 is drawn out through conduit 82 by a centrifugal pump 84 driven by an electric motor 86. Feed water discharged by pump 84 is fed through a conduit 85 connected to feed water distributor 22 by a coupling 87. To insure a continuous supply of feed water to the high pressure pump, a backup centrifugal pump 88 driven by an electric motor 90 is preferably provided in a conduit 91 in parallel with conduits 82 and 85. Pumps 84 and 88 preferably provide feed water at a pressure of about 60 psi and a portion of this feed water may be supplied as cooling water for the high pressure nozzles, such as by connecting a cooling water conduit 92 to feed water discharged conduit 85 by a coupling 93. Conduits 82, 85, 91 and 92 may all be made of a flexible hose material and all of the components upstream of high pressure water nozzles 95, as shown in FIG. 1, may be made portable by being mounted on a trailer. The rating of electric motors 86 and 90 preferably is about 5 horsepower to provide a flow of 23 gpm at 60 psi to high pressure pump 20 and the necessary cooling water flows.

The water pressurized by pump 20 is discharged through an outlet header 52 which contains a water pressure sensor 54, a pressure relief valve 56 and a pressure blowout disk 58. In the cleaning applications described hereinafter, the circuitry of pressure sensor 54 may deactivate pump motor 40 at a pressure of about 12,500 psi, relief valve 56 may be set to relieve pressure at about 12,700 psi, and disk 58 may be selected to rupture at about 13,000 psi. To conserve water, pressure relief valve 56 is preferably connected by a conduit 57 to water recycle conduit 66. Outlet header 52 is connected by a high pressure conduit 61 to a supply header 60 from which high pressure water is supplied through a high pressure conduit 62 to a high pressure water distributor, generally designated 100.

Supply header 60 may also receive high pressure water through a conduit 61*a* from a second high pressure water pump, which is not shown because it is the same as pump 20, and supply high pressure water through a second high pressure conduit 62*a* to a second distributor, which is not shown because it is the same as distributor 100. Additional high pressure water pumps and additional distributors may be connected to supply header 60 depending on the number of cleaning nozzles 95 to be supplied with high pressure water by the fluid systems. Excess high pressure water beyond the amounts required for the high pressure nozzles connected to the distributor(s) is returned to the feed tank 70 via a proportioning valve 64 in recycle conduit 66.

High pressure water distributor 100 includes an air actuated diverter valve 102 for returning high pressure water to holding tank 70 in order to intermittently deactivate the high pressure water nozzles, generally designated 95, while permitting the high pressure water pump 20 to continue to operate. Due to the high water pressures involved, significant force is required to operate diverter valve 102 and this force is provided by a rotary actuator 104 having a pair of dual headed pistons 106,106, each of the four piston heads being actuated by a corresponding one of air cylinders 96, 97, 98 and 99.

Figure 4:
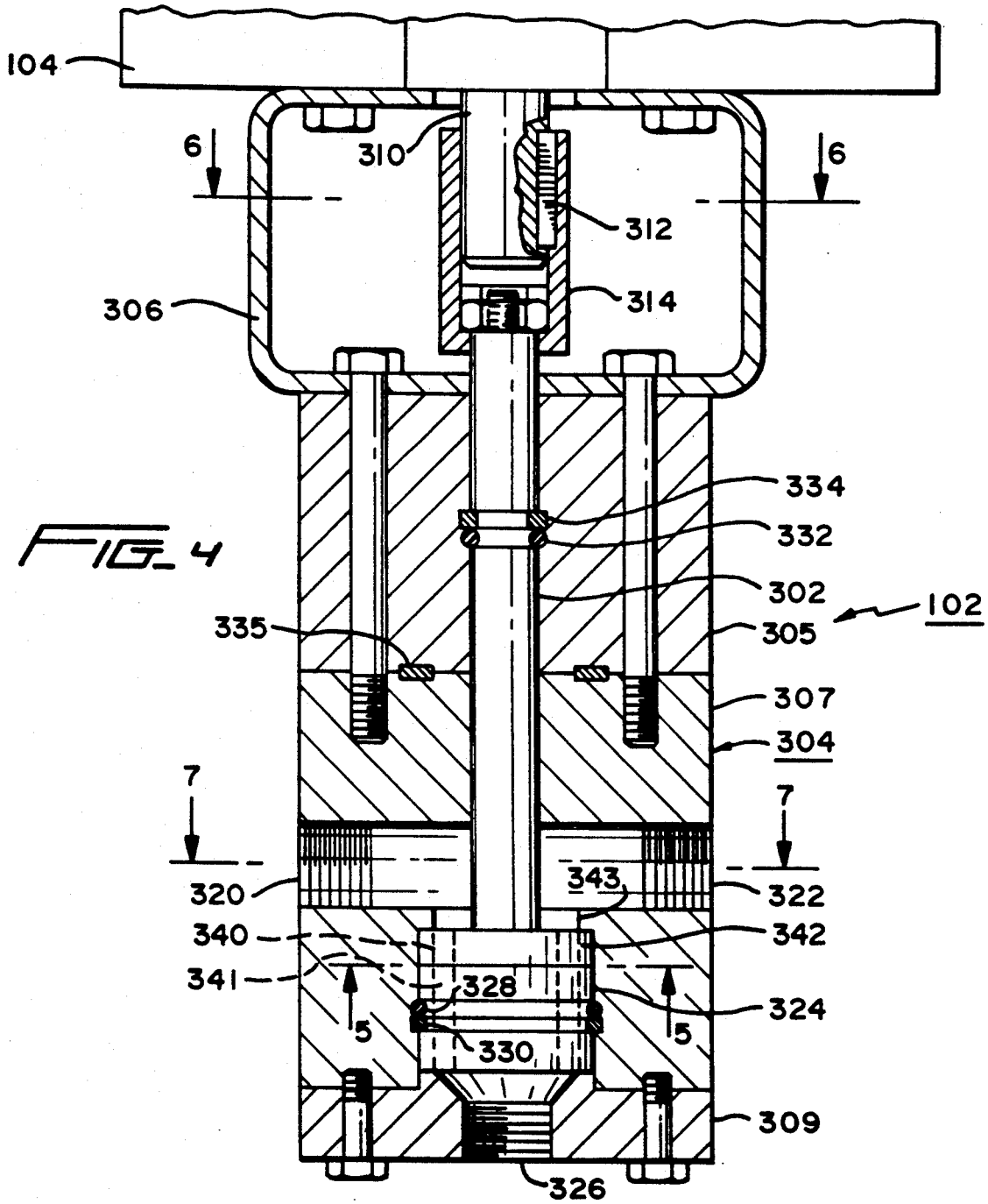
FIG. 4 is an elevational view of the high pressure water diverter valve of the invention in section taken along line 4—4 of FIG. 1.
Figure 5:
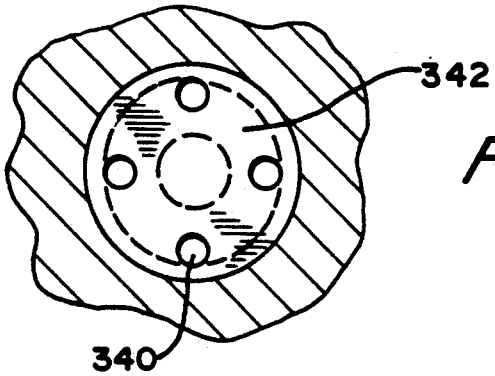
FIG. 5 is a fragmentary sectional view of the high pressure water diverter valve taken along line 5—5 of FIG. 4.

Pressurized air, preferably at about 150 psi, is supplied to the air cylinders by an air distributor 110 having a pair of two-way headers 112,112. The air distributor 110 contains an internal shuttle valve (not shown) which is actuated by an electrically operated solenoid 116. When valve 102 is opened to divert water to tank 70 through a flexible hose 103, pressurized air is supplied to cylinders 96 and 99 through air tubes 115*a* and 115*b*, respectively, and air is exhausted from cylinders 97 and 98 through air tubes 114*a* and 114*b*, respectively. Similarly, when high pressure water is supplied to nozzles 95 through hoses 117, pressurized air is supplied through tubes 114*a* and 114*b* to cylinders 97 and 98, respectively, and air is exhausted from cylinders 96 and 99 through tubes 115*a* and 115*b*, respectively. Pistons 106,106 are pivotally connected to opposite sides of a central rotary shaft 107 which operates a valve actuator within valve 102 as described below with reference to FIG. 4.

Air distributor 110 is provided with compressed air from a compressor or other pressurized air source (not shown) through a supply line 118 which preferably contains a moisture separator 120, an oiler 122 for injecting an oil mist into the air, and a pressure regulator 123 having an adjusting knob 125 for setting the pressure of air being supplied to the air distributor. Although air is referred to in this specification by way of example, other pressurized gases may be used to operate actuator 104. Air leaving the air cylinders is exhausted through a pair of discharged lines 128,128 which are connected to a common exhaust line 129 containing a muffler 130. An air inlet orifice 124 and a pair of exhaust orifices 126,126 are preferably provided at air distributor 110 to control the rate of movement of pistons 106,106 and to avoid air hammer when the shuttle within air distributor 110 moves from one position to the other.

Each of the nozzles 95 include a nozzle body 140 and a rotating head 141 driven by an electric motor 142. The rating of electric motor 142 is preferably about 3 horsepower. The four nozzle bodies shown in FIG. 1 are mounted on a frame (not shown) which either may be held in a fixed position as an elongated workpiece 152 moves axially through a work station 150, or may be moved relative to a workpiece held in a fixed position.

Electrical Operating Systems

The electrical components and circuits for operating high pressure pump motor 40 are associated with a high pressure pump control panel 200, and the electrical components and circuits for operating the feed water motors 86 and 90, the air distributor solenoid 116 and the water nozzle motors 142 are associated with a fluid system control panel 250 as illustrated diagrammatically by electrical lines 151–163 on FIG. 1. The electrical components and their corresponding circuitry will now be described in more detail with reference to FIGS. 2, 3A and 3B.

Figure 2:
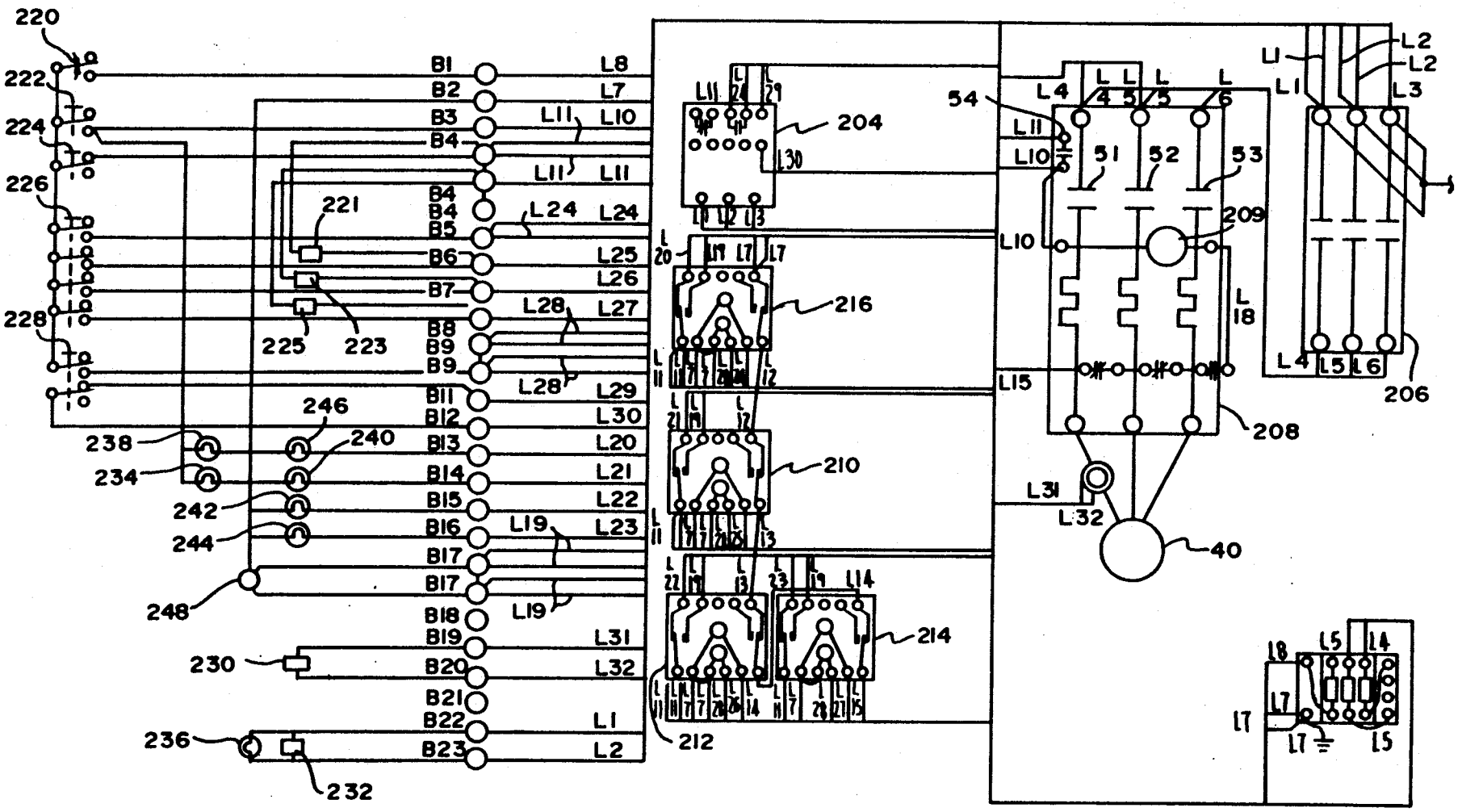
Figure 9A:
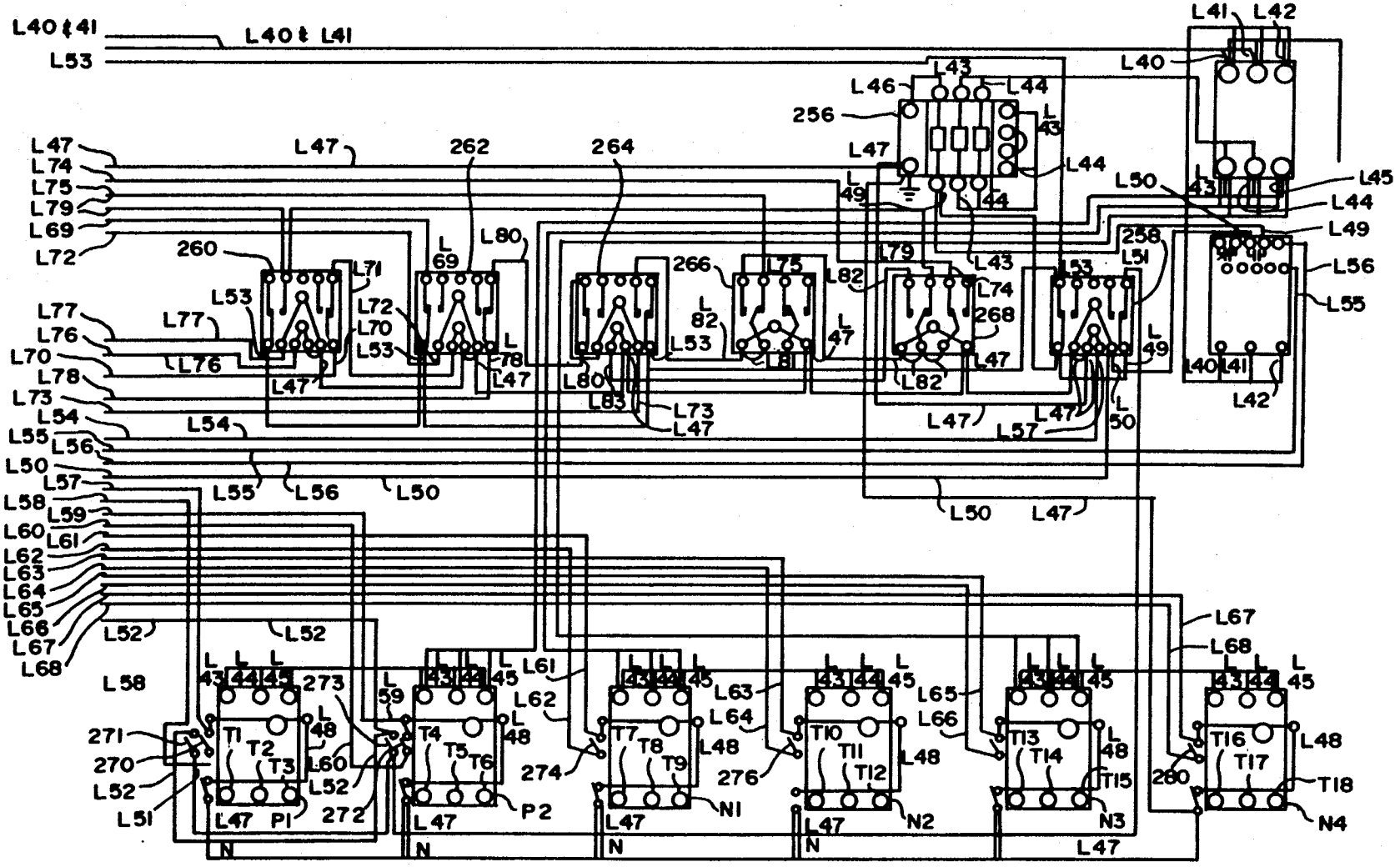
FIG. 9 is a sectional view of the high pressure water nozzle of FIG. 8.

FIG. 2 shows an embodiment of the circuitry for the high pressure pumping unit control panel 200. This circuitry is comprised of a main transformer 202, a system voltage monitor (SVM) 204, a 250 amp and 480 volt lever actuated disconnect switch 206, and a magnetic starter (MGS) 208 connected to the motor 40 of high pressure pump 20. The circuitry includes a low water pressure relay (LWPR) 210 connected to sensor 33 on the inlet header 32 of the high pressure pump (preferably set at about 50 psi), a high crank case temperature relay (HCTR) 212 (preferably set at about 180° F.), a high discharge pressure relay (HDPR) 214 (preferably set at about 12,500 psi), and an electrical supply failure relay (ESFR) 216. Each of these relays is preferably of the dual mechanical latching type, more preferably a Potter & Brumfield Model KBP-11AG-120 relay. This circuitry also includes on the face of control panel 200 an on/off toggle switch 220, a start switch 222, a stop switch 224, a test switch 226, a reset switch 228, an ammeter 230, a volt meter 232, an hour meter 234, a power available indicator 236 with an amber light, a running indicator 238 with a green light, and four indicators 240, 242, 244 and 246 having green lights and corresponding to each of the relays 210, 212, 214 and 216 in their running condition. This circuit also includes an amber lighted warning indicator 248. B1 through B23 are the connecting terminals of a terminal board on the rear side of panel 200.

The high pressure pump motor 40 is preferably a 150 horsepower Marathon Motor, Model No. 445TTFS 8036, which operates at 1800 rpm and requires 480 volts. The operation of motor 40 is controlled through the plurality of switches on the control panel and by observing the signal lamps and meters on this panel.

Electrical lines L1–L3 are connected to a 3-phase electrical power source (not shown) capable of providing 250 amps of A/C current at 480 volts. The system voltage monitor 204 monitors the incoming power supply for phase loss, phase reversal, undervoltage, and phase imbalance, and energizes the ESFR 216 via lines L24 if any of these parameters are out of tolerance. The magnetic starter (MGS) 208 includes a magnetic coil 209 which is operated from the start and stop switches 222 and 224 through lines L10 and L11. Depressing the start switch 222 energizes via line L10 the magnetic coil 209, which closes auxiliary switches S1, S2 and S3 to supply current to motor 40. Magnetic coil 209 also closes auxiliary switch S4 so as to maintain a current via line L11 to keep magnetic coil 209 actuated. Depressing the stop switch 224 breaks the connection through line L11, thereby causing switches S1–S4 to open.

The magnetic coil 209 is connected to ground line L7 via line L15, HDPR 214, line L14, HCTR 212, line L13, LWPR 210, line L12, and ESFR 216, so that MGS 208 will disconnect if any of these relays is energized. LWPR 210, HCTR 212, and HDPR 214 are connected to remote light switches 221, 223 and 225 via lines L25–L27 and operate the corresponding one of these switches when the monitored parameter is out of the required tolerance, these relays also being connected to green light indicators 240, 242 and 244 via lines L21 through L23, respectively. Each of these relays also is connected to the amber lighted warning indicator 248 via lines L19. The rest of lines L1–L30 are connected as shown in FIG. 2.

Figure 3B:
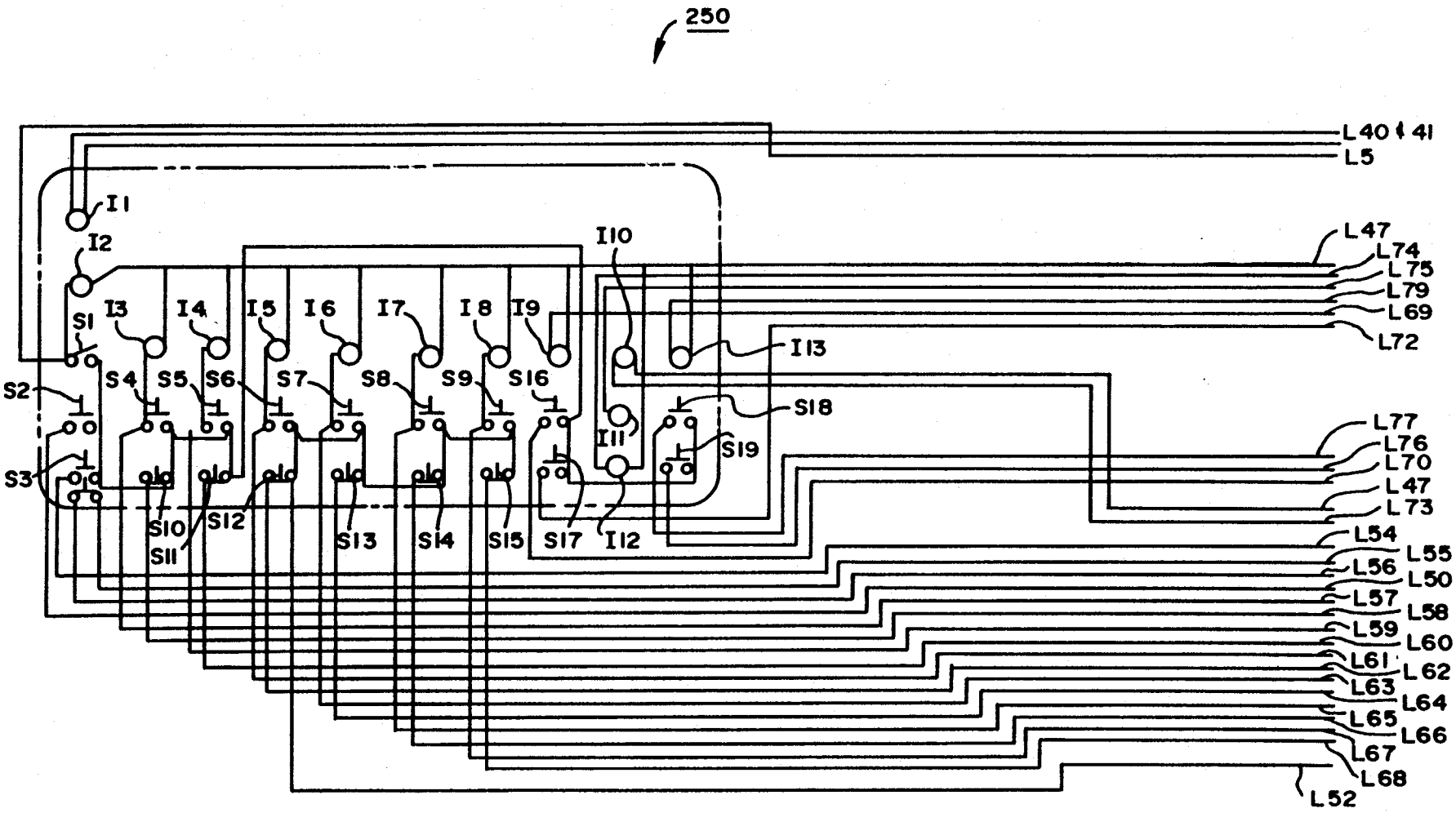

As shown in FIGS. 3A and 3B, the feed pump and nozzle control panel 250 comprises a 60 amp main disconnect switch 252; a system voltage monitor 254 which monitors for phase loss, phase reversal, under voltage, and phase imbalance in the incoming electrical power; a main transformer 256 for supplying the current at 120 volts to operate the system; six magnetic starters $P_1$, $P_2$, $N_1$, $N_2$, $N_3$, $N_4$ for operating the two feed pump motors 86 and 90 and the four nozzle motors 142; four dual coil mechanical latching relays (preferably Potter & Brumfield Model KBP-11AG-120) which operate as an electrical supply failure relay (ESFR) 258, a continuous run signal relay (CRSR) 260, an off/on signal relay 262, and a cycle relay 264; and two double-pole, double-throw delay relays which operate as an off time relay 266 and an on time relay 268.

Relays 260, 262, 264, 266 and 268 operate in conjunction with solenoid 116 of air actuator valve 110 of the high pressure water distributor 100. The continuous run signal relay 260 is energized by the continuous on switch S18 and deenergized by the continuous off switch S19 of FIG. 3B. Energizing relay 260 positions air actuator valve 110 to provide a continuous flow of water to the nozzles 95 as desired. The off/on signal relay 262 is connected to an external 120 volt power source (not shown) which provides a plant signal for timed operation of air actuator valve 110. This plant signal originates externally of the circuitry shown and is a timing signal which allows the nozzles to be cut on and off in a timed cycle, such as required on an assembly line.

The off/on signal relay 262 is connected to on and off switches S16 and S17 in FIG. 3B via lines 70, 71 and 72. Relay 262 arms the timing system and allows the plant signal to come in at its predetermined time. The cycle relay 264 is energized when the plant signal comes through the off/on signal relay 262 and this initiates the timing sequence, after which relay 264 resets for awaiting the next signal. The off time relay 266 responds to the plant signal through the cycle relay 264. The plant signal thus operates the cycle relay 264 to connect the external 120 volt power source to the off time relay 266. The off time relay 266 contains a variable potentiometer (not shown) as a timer, which disconnects the external power source for a short predetermined duration. After this short duration, the relay 266 is tripped, which sends the signal to the on time relay 268 which in turn signals the solenoid 116 of actuator valve 110 to move the shuttle to its position for actuating operation of nozzles 95. The on time relay 268 is another timed relay which can be set for the desired length of operation of nozzles 95.

The feed pump motors 86 and 90 and nozzle motors 142 are connected to electrical power through magnetic starters $P_1$, $P_2$ and $N_{1-4}$, respectively, via terminals T1–T18 as shown in FIG. 3A. These starters contain magnetic coils (not shown) which are energized by the respective start switches S4–S9, which as shown in FIG. 3B are connected through lines L57–L68. The respective start switches S4–S9 thus close switches 270, 272, 274, 276, 278 and 280 on the magnetic starters $P_1$, $P_2$, $N_1$, $N_2$, $N_3$, and $N_4$, respectively. Starters $P_1$ and $P_2$ have second switches 271 and 273, respectively, which must be closed in order for the switches of starters $N_{1-4}$ to operate.

Referring to FIG. 3B, the feed pump and nozzle control panel 250 comprises on its face: an amber lighted power available indicator I1 connected via lines L41 and L42 to the main disconnect switch 252 (FIG. 3A); a green lighted electric supply fault indicator I2; and on/off toggle switch S1 for supplying power to the panel indicators and switches; a test switch S2 and reset switch S3 connected through lines L50 and L54 to the ESFR 258 and through lines L55 and L56 to the SVM 354 (FIG. 3A); start switches S4–S9, stop switches S10–S15 and green lighted indicators I3–I8, one of each being for feed pumps $P_1$ and $P_2$ and for nozzles $N_1$, $N_2$, $N_3$, $N_4$, and being connected to the pumps and nozzles via lines L57 through L68; an on switch S16, an off switch S17 and a green lighted indicator I9 for arming the timed cycle used in operating the actuator valve 110; an amber lighted indicator I10 for signaling the receipt of the plant signal and connected via lines L47 and L73 to the components of FIG. 3A; amber lighted indicators I12 and I12 for signaling when the off time signal relay 266 and on time signal relay 268 are in operation and connected via lines L75 and L74 to the components of FIG. 3A; an amber lighted indicator 113 for signaling when the actuator valve 110 is operating and connected via lines L79 to the components of FIG. 3A; and a continuous on switch S18 and a continuous off switch S19 for operating actuator valve 110 as previously described. The rest of lines L40–L83 are connected as shown in FIGS. 3A and 3B.

A High Pressure Diverter Valve

Referring now to FIGS. 4–7, there is shown a preferred embodiment of the high pressure diverter valve 102 which comprises a rotatable shaft 302 housed in a valve body 304 having three sections 305, 307 and 309. Valve body 304 is attached to the underside of the rotary actuator 104 by a bracket 306. Rotatable shaft 302 is driven by an extension 310 of actuator shaft 107 which is rotated by the pistons of rotary actuator 104 as previously described. Rotary motion of actuator extension 310 is transmitted to rotatable shaft 302 by a sleeve 314 which is locked to extension 310 by a key 312.

Water enters valve 102 from high pressure pump 20 via water inlet 320 and exits to a pair of the nozzles 95,95 through radial outlets 322 and 323. When not directed to the nozzles, the water is diverted axially through openings 340 in a rotatable valve member 342 at the distal end of shaft 302 and then through openings 341 in a fixed valve seat member 324, which is on the side of valve member 342 opposite to a seating ledge 343 of section 307. Water from openings 341 is discharged through a recycle outlet 326, which is connected to recycle line 103 (FIG. 1). Water is recycled when openings 340 are aligned with openings 341 and is directed to the nozzles when openings 340 are turned about 45° out of alignment with openings 341. Water leakage around fixed valve seat 324 is blocked by an O-ring 328 held in place by a backing ring 330, and water leakage around the opposite end of rotatable shaft 302 is blocked by an O-ring 332 held in place by a backing ring 334. A seal ring 335 prevents water leakage between the abutting surfaces of sections 305 and 307.

A Motor Actuated Liquid Nozzle Assembly

Figure 8:
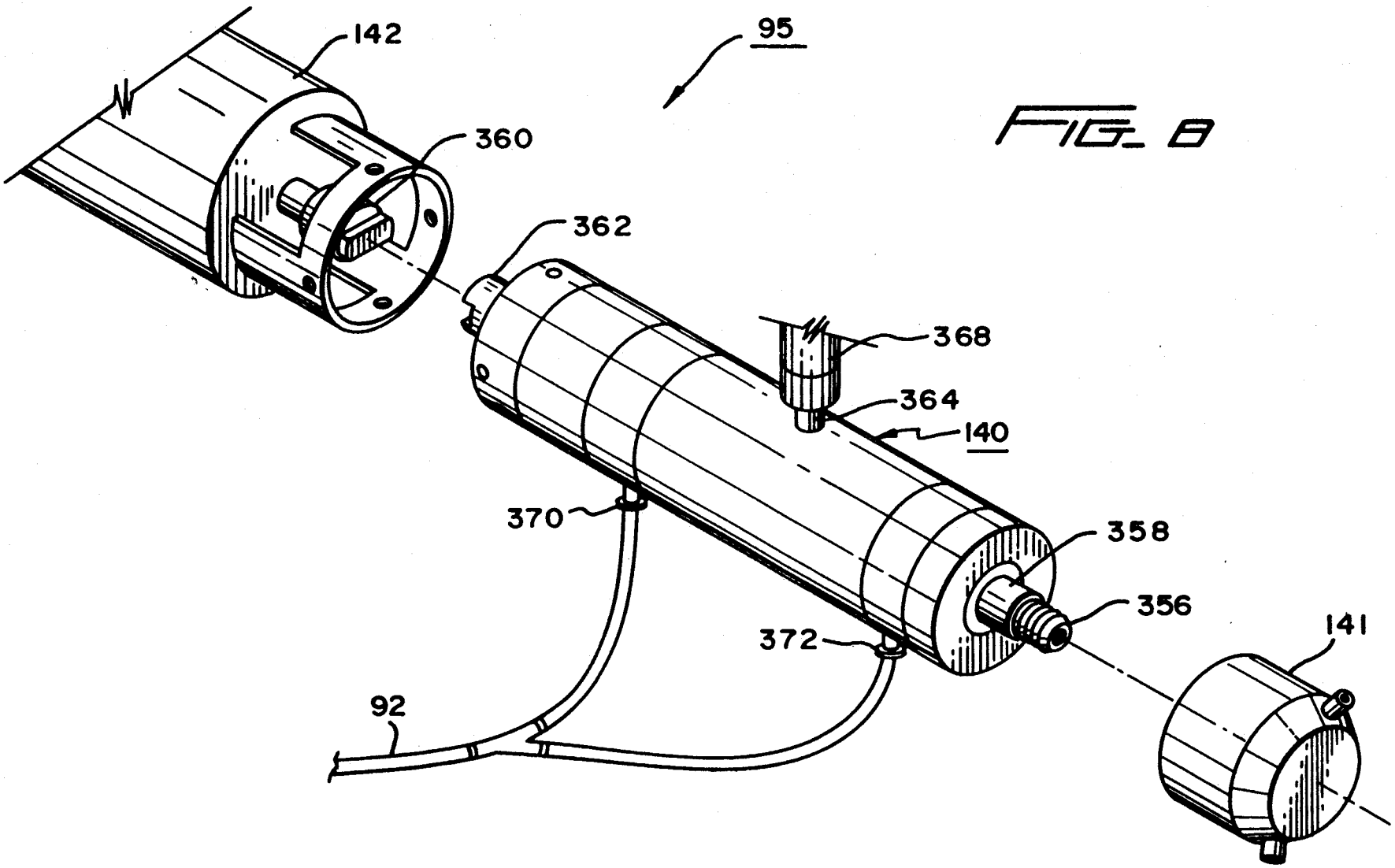
FIG. 8 is an exploded view of a motorized high pressure water nozzle in accordance with the invention.
Figure 9:
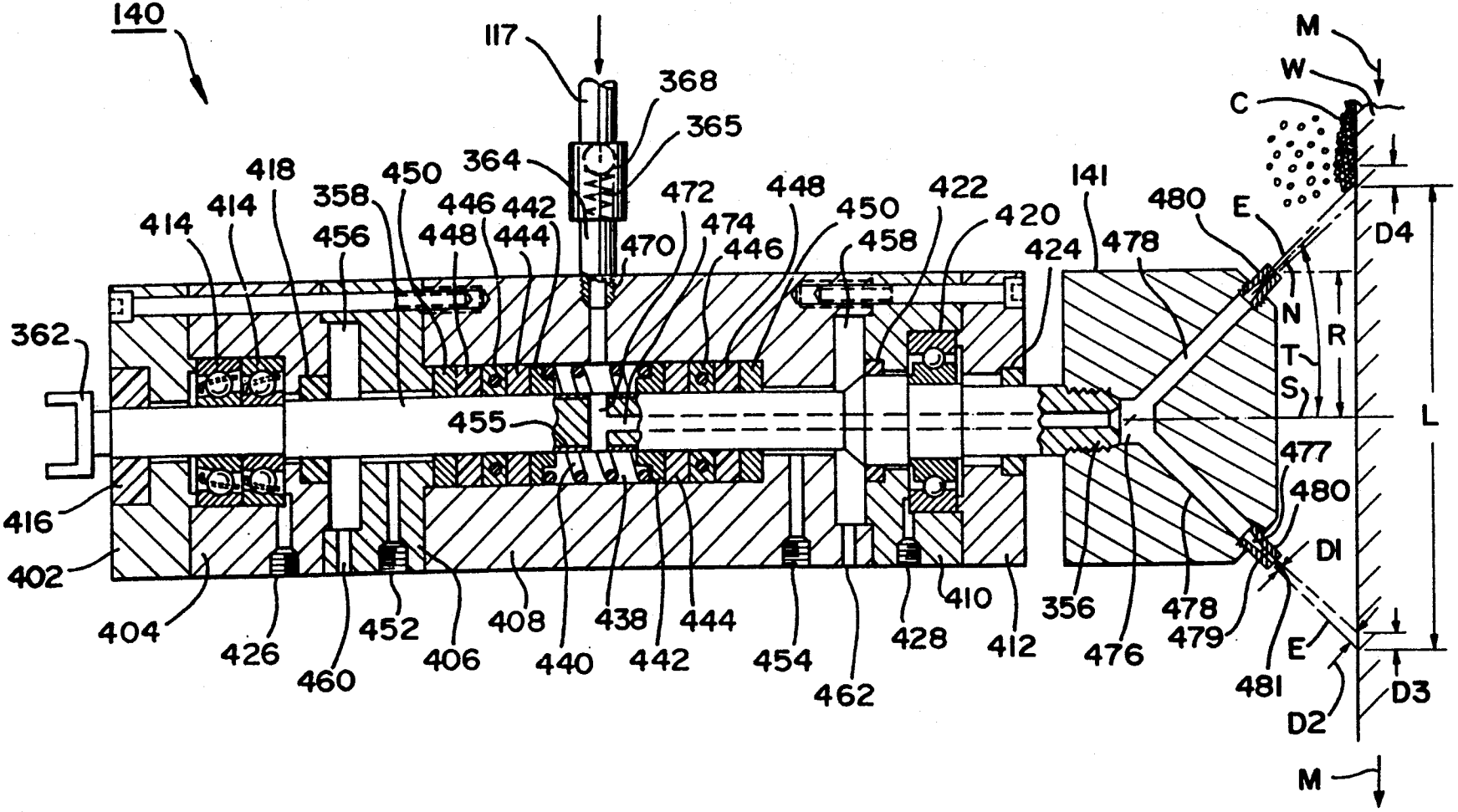

FIGS. 8 and 9 show details of a preferred embodiment of the motor rotated nozzle assembly for liquids, which is designated generally as 95 in FIG. 1. FIG. 8 is an exploded view showing the motor 142, the nozzle body 140 and the spinning head 141 detached from each other. Head 141 is attached to a threaded end 356 of a rotatable shaft 358 which is rotatably driven by the motor 142. A driving coupling 360 on the motor shaft engages a driven coupling 362 at the opposite end of nozzle shaft 358. A high pressure water inlet nipple 364 is connected to a pressure actuated ball valve 368 which receives water from high pressure water distributor 100 via conduit 117, valve 368 remaining closed until the water pressure in conduit 117 exceeds the seating force of a spring 365. This seating force is not exceeded while diverter valve 102 is recycling water to ambient pressure through flexible hose 103. Two cooling water nipples 370 and 372 receive low pressure feed water from conduit 92 (FIG. 1).

The nozzle body 140 of motor-actuated nozzle assembly 95 is shown in cross-section in FIG. 9. The rotatable shaft 358 has a tungsten carbide or other hard surface coating 455 and is arranged to rotate in the housing provided by nozzle body 140. The hard surface coating greatly extends the useful life of shaft 358 and is preferably a tungsten carbide coating provided by Stellite, Inc., of Goshen, Ind. Nozzle body 140 comprises a rear bearing cap 402, a rear bearing housing 404, a packing housing rear plate 406, a shaft packing housing 408, a front bearing housing 410 and a front bearing cap 412.

Rear bearing housing 404 houses two combined rearward thrust and radial thrust bearings 414,414. Adjacent seals 416 and 418 protect bearings 414 from water and dirt and retain a grease lubricant therein. Front bearing housing 410 houses a single radial bearing 420. Adjacent seals 422 and 424 protect bearing 420 from water and dirt and also retain a grease lubricant therein. Grease fittings 426 and 428 allow bearings 414,414 and 420, respectively, to be lubricated.

Shaft packing housing 408 houses a compressed coil spring 440, a pair of opposing bronze or VESPEL spring guides 442,442, a pair of opposing graphite rings 444,444, a pair of opposing composite rings 446,446 each comprising intertwined graphite and carbon ropes, a pair of opposing KEVLAR bull rings 448,448, and a pair of opposing bronze throat bushings 450,450 which prevent the packing rings 444, 446 and 448 from being extruded through the shaft to housing clearances by the high pressure water which enters a nozzle body chamber 438 from inlet nipple 364. Shaft packing cooling water from nipples 370,372 enters through cooling water inlets 452,454 into packing cooling chambers 456 and 458, respectively, and then drains from these cooling chambers through cooling water outlets 460,462. High pressure water from high pressure pump 20 passes through high pressure water inlet ball valve 368 and through high pressure water inlet 470 into chamber 438, from which it is then discharged through an axial passage 474 in rotating shaft 358.

To prevent water entry into shaft 358 from applying radial thrust against this shaft, the means of discharging high pressure water from chamber 438 comprises a radial inlet passage 472 extending entirely across the diameter of shaft 358 and intersecting with axial passage 474. The opposing inlet ports thereby provided prevent the entering water streams from applying any substantial net radial thrust to shaft 358. Axial passage 474 discharges the water to a distribution chamber 476 in rotating head 141, and from there the water flows via passages 478,478 to a pair of nozzle tips 480,480 each having a tapered bore section 477 followed by a straight orifice bore section 479 and an orifice discharge opening 481. Passages 478,478 preferably have about the same diameter as the inlet openings of tapered bore sections 477,477 of the nozzle tips in order to minimize the turbulence created in the transition from head to tip. It is also believed that tapered sections 477,477 dampen such turbulence and avoid creating significant additional turbulence at the transition from tapered section 477 to straight section 479. Such turbulence may interfere with focusing the ejected water streams.

The focused nozzle tips employed also may have conventional refinements in the cross-sectional shape(s) of the bore, provided such refinements are designed to keep the water stream ejected from the orifice opening together as a substantially solid stream of liquid for as long a distance as possible. Conventional nozzle tips of the "focusing" type, which may be converted to the highly focused tips of the invention, are generally made of carbide and are available in various orifice sizes from different U.S. and foreign manufacturers. By way of example, the nozzle tips 480,480 may have orifice diameters in the range of 1 to 2 mm, such orifice sizes being available from the Hammelmann Company of Oelde, Germany, or the range of 0.041 to 0.075 inches, such orifice sizes being available from Arthur Products, Inc., of Medina, Ohio.

FIG. 9 also provides a diagrammatic illustration of the substantially solid stream of ejected water provided by the "focused" water nozzle tips of the invention. Immediately adjacent to orifice opening 481, the water stream has an initial diameter D1, which then expands to a larger diameter D2 before impacting the surface of a workpiece W. This expansion in the diameter of the ejected water stream E is due to the interaction of the high velocity water with the surrounding air through which the water must travel before it impacts the workpiece. The rate of expansion of ejected stream E is a function of the shape of the orifice bore as previously explained, and also of the velocity at which the water stream leaves the orifice opening. The exit water velocity employed the present invention is preferably in the range of 900 to 3,000 ft./sec., more preferably about 1,100 to 2,500 ft./sec., and most preferably about 1,500 ft./sec.

In the embodiment of FIG. 9, the orifice axis N is canted radially outward from the spin axis S by an angle T, which may be in the range of zero degrees (no cant angle) to 85°, preferably 70° or less, more preferably 65° or less, most preferably in the range of about 40° to 50°. The specific value for angle T selected within these ranges depends upon the application, e.g., the type of coating, the shape and type of substrate from which the coating is to be removed, and whether there is any tilt of the orifice axis out of the plane of the spin axis, such as with self-actuated spinning heads as described below. As also illustrated in FIG. 9, the physical impact of the solid water stream E against a coating C loosens and breaks up the coating into particles of debris D as the workpiece W moves in the direction M. Because the diameter of the water stream is small to preserve the force of impact, the surface coverage provided by one sweep of the spinning nozzle tip is also small and is represented by the distance D3, (annular path width). As the workpiece W moves linearly past the spinning nozzle head 141, the core portion of the focused water stream also produces a linear path having a width L, which substantially exceeds twice the sum of the annular path width D3 and the radial distance R between the orifice opening 481 and the spin axis S as shown in FIG. 9.

As previously described, the spinning of nozzle head 141 provides a hollow cone of water, the wall thickness of this cone corresponding to the diameter of the substantially solid water stream core, which varies with the distance from the orifice opening 481. In this illustration, the angle T is about 45° and provides a core impact coverage over a lateral distance D3, the distance D3 being about 41% greater than the diameter D2 since the distance D3 is roughly equivalent to the hypotenuse of an isosceles right triangle, the legs of which are represented by diameter D2. Only where the angle T is zero will the distance D3 equal the diameter D2 (assuming the orifice axis N is not tilted out of the plane of spin axis S). As also previously indicated, nozzle head 141 is preferably rotated sufficiently rapidly so that the second nozzle tip will provide a coverage D4 by the time the workpiece has traveled laterally a linear distance in the direction M equal to D3, D3 being equal to D4 where the diameters of the streams ejected by both tips are the same.

A Self-Actuated Liquid Nozzle Assembly

FIGS. 10 and 11 show a preferred embodiment of a self-rotating nozzle 482, which is an alternative embodiment to the motor actuated liquid nozzle of FIGS. 8 and 9. As shown best in FIG. 11, a rotatable shaft 483 is housed in a nozzle body 484. Body 484 comprises a front end plate 486, a weep housing 488, a packing housing 490 and a rear end plate 492, all held in alignment by three identical alignment pins 494. Three identical seal rings 495 prevent water leakage from the side of body 484. Seal rings 495 are preferably made of a synthetic seal material, such as DELRIN available from the DuPont Company. End plates 486 and 492 and housings 488 and 490 are centered by steps 489, 491 and 493 and are secured together axially by a plurality of circumferentially spaced bolts 497, preferably six in number.

The nozzle 482 further comprises a throat bushing 498, a packing bushing 502, a composite packing ring 503, a retainer bushing 504, an O-ring seal 506 and a backup seal ring 508. Throat bushing 498 and packing bushing 502 are preferably made of brass or of a hard synthetic material, such as TORLON available from Amoco Chemical Company. Packing ring 503 is preferably made of a softer synthetic packing material such as KEVLAR available from the DuPont Company. The inside diameter of packing ring 503 relative to the outside diameter of a shaft distal end portion 505 is such that there is sufficient water leakage into an inner chamber 507 to lubricate shaft 483 and an annular thrust boss 509 thereof housed in chamber 507. A water inlet connector 510 directs high pressure water through a passage 512 in rotatable shaft 483 to a rotating nozzle head 500 which comprises an elongated bar 514 having an axial bore 516 closed at one end by a threaded plug 518 and in fluid communication with passage 512.

A pair of nozzle tips 520,520 are tapped into bore 516 and are tilted in opposite directions out of an axial plane containing the spin axis of shaft 483 as shown best in FIG. 10 (the axial plane being the same as the sectional plane defined by section lines 11—11 of FIG. 10). The angle of tilt is preferably in the range of 5° to 20°, more preferably 10° to 15°, relative to the spin axis. A tilt angle of 10° is most preferred where tips 520,520 are spaced laterally apart by about 3 inches, i.e., 1½ inches away from the spin axis. This positioning and canting of the nozzle tips 520,520 causes the water discharge to generate sufficient tangential reaction forces to provide rapid spinning (up to about 5,000 rpm for water pressures up to about 12,000 psi) of head 500. The bores of nozzle tips 520,520 are illustrative of the general shape of the highly focused tips wherein the tip bore has a converging conical entrance section 521 followed by a substantially straight cylindrical section 523 of uniform diameter.

A Metal Billet Descaling Method

In the embodiment shown in FIG. 1, four (4) high pressure water nozzles 95 are arranged at work station 150 for cleaning scale from a hot metal billet 152 which is moved past the rotating heads 141 by a conveyor (not shown) as high pressure water discharged from the spinning nozzle heads 141 impacts against opposing surface areas of the billet. The water discharged by the nozzles, along with removed scale and other debris, is collected in a drain 146, and is preferably returned back to the separation pond or other water source supplying feed water to holding tank 70 through conduit 72. As viewed from each nozzle motor, the nozzle heads on the right side of the billet axis (as viewed in FIG. 1) preferably rotate in the clockwise direction and those on the left side preferably rotate in the counterclockwise direction in order to propel removed debris in the direction (into the page of FIG. 1) from which the billet enters station 150. The spin axes of the nozzles also are preferably offset by ½ inch or more from each other in the same direction to avoid the possibility of any deleterious interference between the respective cleaning patterns of the nozzles.

The work station 150 of FIG. 1 also may be arranged such that the water nozzles 95 are moved longitudinally along one or more metal billets arranged at the work station. It also is contemplated that the nozzles may be arranged sequentially, that less or more than four nozzles may be arranged at the work station, and that the nozzles may also be moved circumferentially around the billet.

As previously indicated, the nozzle tips 480 carried by spinning nozzle heads 141 provide substantially solid water streams at very-high velocities and are of the "focused" type. Since the water stream leaving this nozzle tip does not have to change directions and there is relatively little mixing with air prior to impact, there is a concentrated cleaning pattern of high velocity water, which has a longer reach and substantially more energy at the surface being descaled than the tips of prior art nozzles used in descaling steel billets. The coverage problems previously associated with conventional focused nozzle tips is overcome in the present invention by rapidly spinning the nozzle head 141 and controlling the lateral movement of this head relative to the surface to be descaled. The present invention therefore provides the energy and coverage needed to effectively descale a metal billet with about one-fourth or less of the amount of water used in prior art methods for cleaning billets with high pressure water.

Liquid Cleaning of Electrodes

Figure 12:
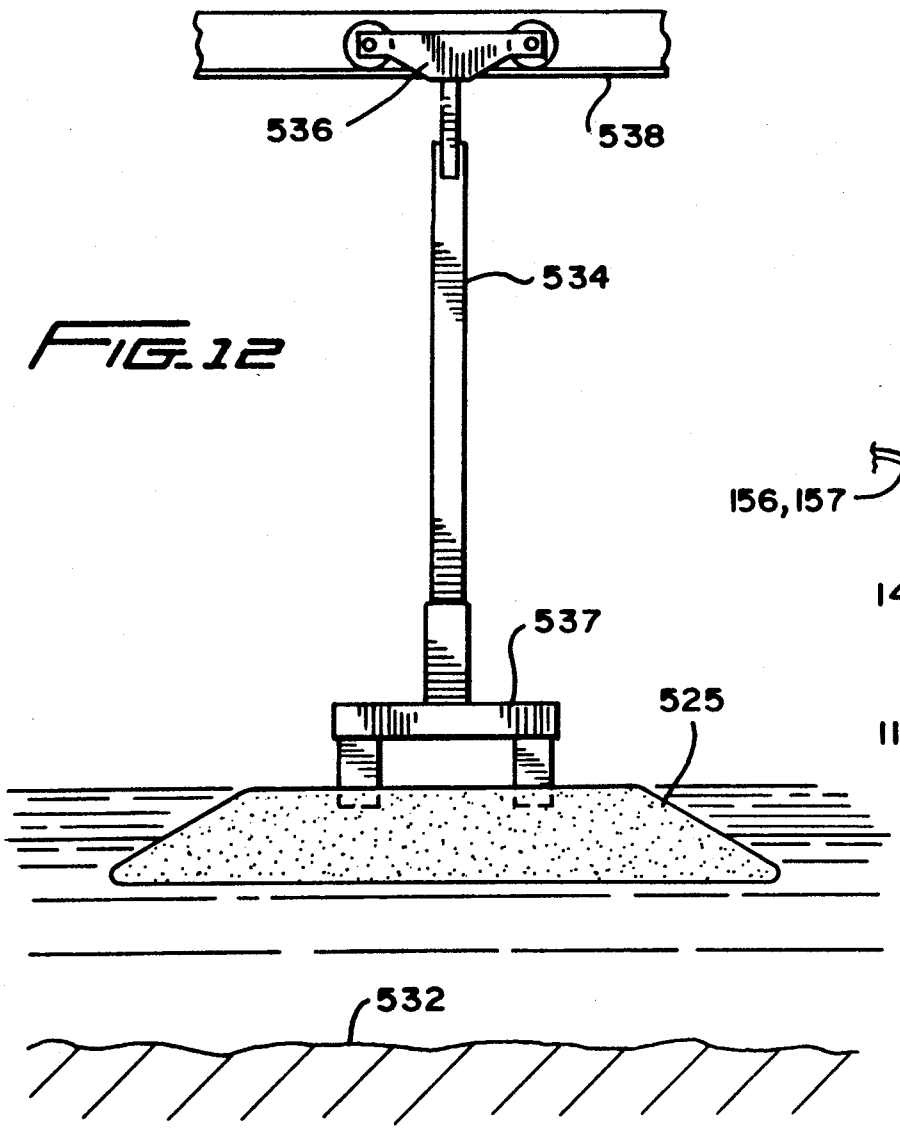
FIG. 12 is a side elevational view illustrating diagrammatically the use of an electrode which later may be cleaned in accordance with the invention.

Referring now to FIGS. 12 and 13, there is shown a method of using the water nozzles of the invention for cleaning deposits from electrodes, such as cleaning a coating 525 of "bath" deposits from an expended carbon anode 526. The bath deposits accumulate on anode 526 while the latter is suspended in an electrolytic bath 530 over a mass 532 of molten metal, such as aluminum ore, by a vertical copper support arm 534 which in turn is suspended from a trolley 536 movable along a pair of overhead rails 538,538. Typically, the bath coating 525 builds up on anode 526 as electrical energy is passed through the anode and the bath and into the metal mass 532 to keep the latter molten during a metal refining process. Anode 526 eventually becomes depleted and/or the build up of bath 525 sufficiently decreases the anode efficiency such that the depleted anode structure must be moved away along rails 538,538 and replaced by a new anode structure (not shown).

In the anode cleaning method of the invention, after the depleted anode is moved away from bath 530, it is passed through a work station 540 having an opposing pair of side rails 542,542 for guiding anode 526 between the pair of nozzles 95,95 where bath coating 525 is removed from the anode by the high pressure water streams 544,544 omitted from the pair of nozzle tips 480,480 carried by each spinning nozzle head 141,141. For this application, each of the nozzles 95,95 may be mounted on floating arms having substantially the same structure as arm 654 shown in FIG. 21.

The impact energy of the high velocity water streams 544,544 is so concentrated that, as the nozzle heads 141,141 are rapidly spun by the motors 142,142, bath coating 525 is continuously pierced by the fluid pattern of the spinning streams and segments thereof are actually cut away from anode body 526 by these streams which function as a cutting implement. The spinning axes of nozzles 95,95 are tilted away from the vertical by about 8°-14°, preferably about 11°, to improve the angle of attack of streams 544,544 relative to the side surface of anode body 526. The spin axes are also preferably laterally offset from each other in the direction of travel of anode body 526 by a distance sufficient to avoid the possibility of any deleterious interference between the respective fluid patterns of the nozzles. In addition, the heads 141,141 are preferably rotated in opposite directions to propel the removed debris toward the direction from which the anode enters the work station 540, in the same manner as when nozzles 95 are arranged at work station 150 (FIG. 1) for descaling hot metal billets.

Tests have been conducted which demonstrate the utility and efficiency of the invention in cleaning electrical anodes used in the metal refining industry. Only a small amount of water (about two-thirds of a gallon) was required to effectively clean the bath deposit from the body of each anode. Furthermore, only minimal amounts of carbon were removed from the anode, which is desirable because the carbon is subsequently recovered and reprocessed to make new anodes.

A Method And Apparatus For Removing Resinous Coatings

Figure 14:
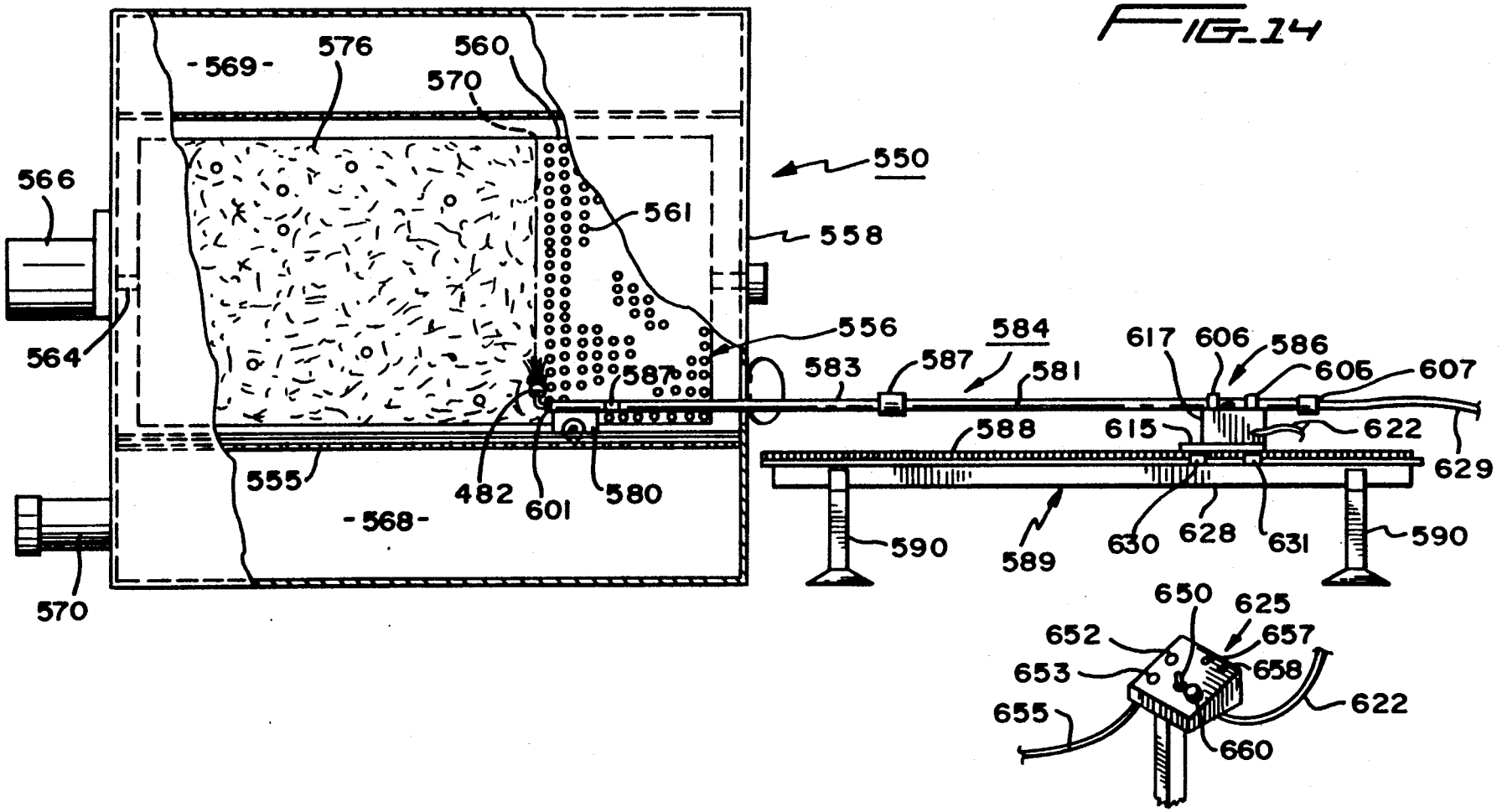
FIG. 14 is a side elevational view in partial section illustrating diagrammatically a modification of the invention as used for cleaning resin-impregnated fibrous material from a perforated drum of a drying machine.
Figure 15:
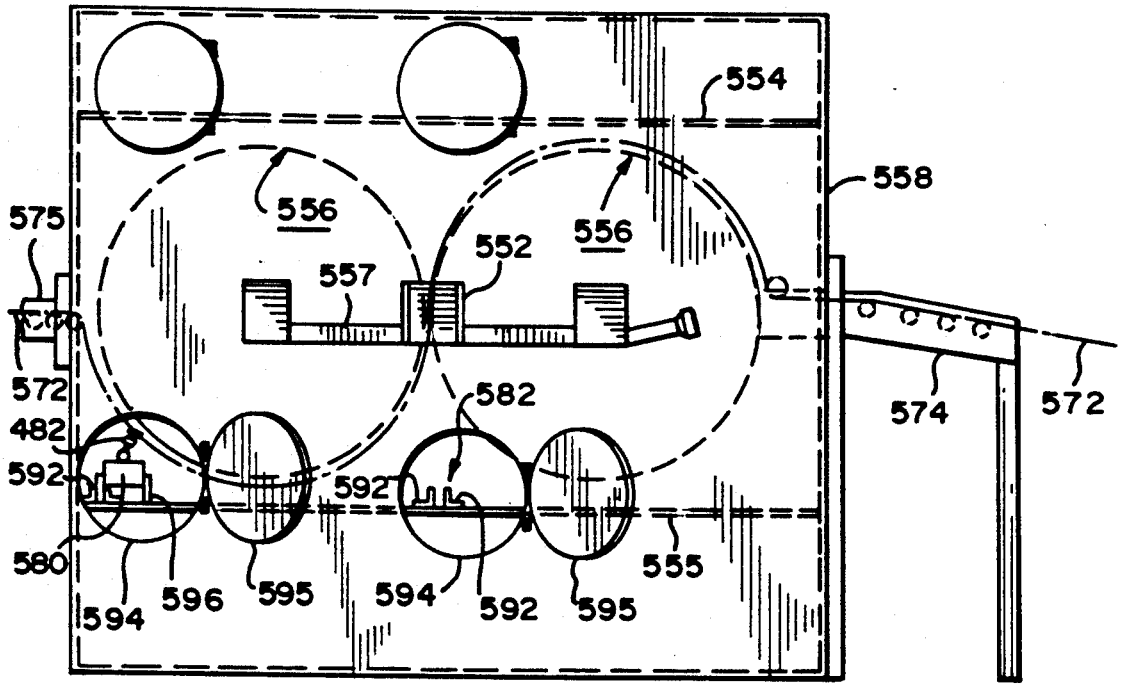
FIG. 15 is a front elevational view of the drying machine being cleaned, by the modification of FIG. 14.

The invention also is effective and efficient in removing dried resinous coatings from metal surfaces, such as in cleaning operations for removing dried resin-impregnated fibrous material from perforated steel drums and calendar rolls in dryers manufactured by Fleissner, Inc., of Germany. One such dryer, generally designated 550, is illustrated diagrammatically in FIGS. 14 and 15. One or more fans 552 suck heated air first through perforated upper and lower baffle sheets 554 and 555, respectively, then through a pair of perforated drums 556,556, and then through duck work 557 positioned in the interior of the drums as shown in FIG. 15. Each drum 556 has a perforated cylindrical wall 560 with a plurality of small openings 561 and is mounted for rotation on a shaft 564, which in turn is rotatably mounted in a drum housing 558 and driven by a variable speed motor 566 as shown in FIG. 14. Heated air is provided to lower and upper air distribution chambers 568 and 569, respectively, by a gas burner 570.

A web 572 of fleece comprising resin-impregnated fibers is fed into housing 558 by a conveyor 574, where the fleece web passes around a portion of each of the perforated drums 556,556 and then exits the housing 558 on a second conveyor 575. The resin of the entering fleece web is uncured and the fleece web is heated to dry and cure the resin as it passes around the drums 556,556. Because both the fleece and the drum perforations offer resistance to the hot air being sucked into the drums from the distribution chambers 568 and 569, there is a partial vacuum in the interior of the drums and this differential pressure pulls the fleece web against the surface of the drums as they rotate. The suction also results in an accumulation over time of a layer of cured resin and fibers which strongly adhere to the surface of the drum as a coating 576.

Over an extended period of dryer operation, the coating 576 builds up sufficiently to cause a significant decrease in the efficiency of the fleece drying and curing operation. When this occurs, the dryer 550 must be removed from operation and the coating 576 removed from both the drum surface 560 and from within the plurality of drum openings 561. The present invention provides an effective, efficient and economical method for removing the coating 576 from the drums 556,556.

In accordance with the invention, there is provided a cart 580 for carrying a water nozzle of the invention, preferably the self-spinning nozzle assembly 482. Cart 580 is propelled along a track 582 mounted in the dryer by a conduit assembly 584 driven by a trolley, generally designated 586, which engages a rack 588 mounted on an exterior track assembly 589 having a pair of supporting stands 590,590. The track 582 for nozzle cart 580 is preferably provided by a pair of opposing angle irons 592,592 which are mounted on lower baffle plate 555 of the dryer through dryer access openings 594,594, which are closed by swinging doors 595,595 when dryer 550 is in operation. Angle irons 592,592 are preferably bolted at two or more locations along their length to lower baffle plate 555. As shown best in FIGS. 15 and 17, the space between angle irons 592,592 receives one of the pair of cart wheels 596,596 to guide nozzle 482 in spaced relation at a fixed distance from the surface 560 of drum 556.

Figure 16:
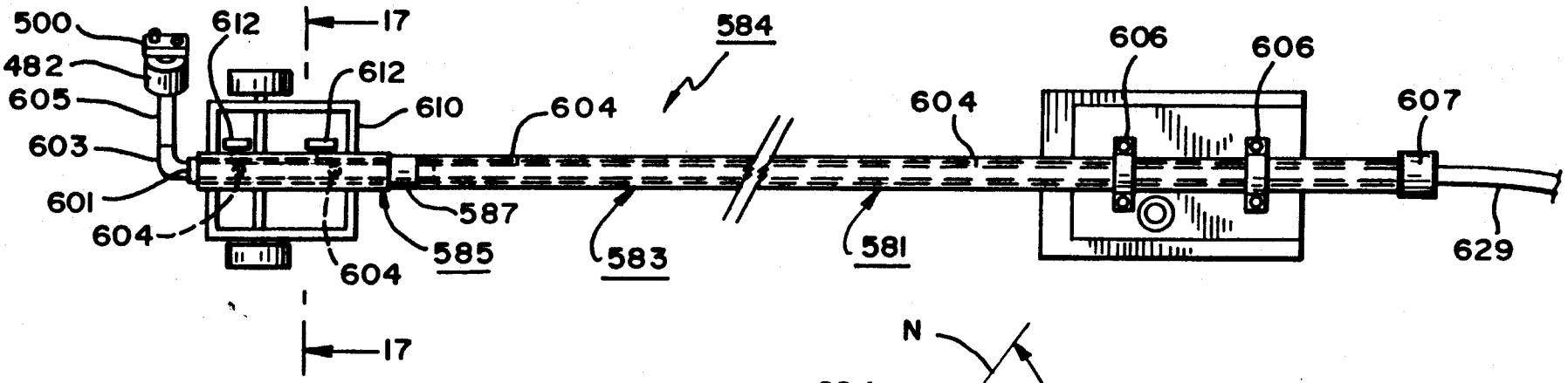
FIG. 16 is a plan view of the modification of FIG. 14 outside of the drying machine.
Figure 17:
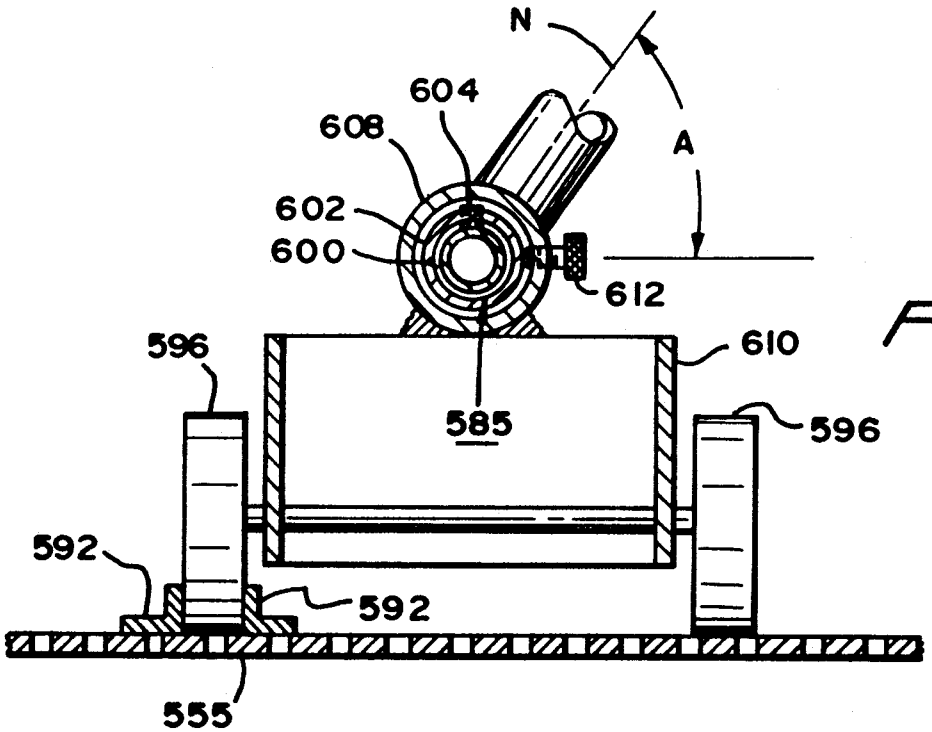
FIG. 17 is an elevational view in section taken along line 17—17 of FIG. 16.

Referring now to FIGS. 16 and 17, the conduit assembly 584 may include a plurality of sections 581, 583 and 585 detachably connected together by couplings 587, each section comprising an innermost high pressure water pipe 600 surrounded by a tubular safety shroud 602 which is clamped to water pipe 600 by two or more set screws 604,604. Pipe 600 is connected to the inlet connector 510 of nozzle 482 through an end coupling 601, a 90° elbow 603 and a nozzle supporting pipe segment 605 of the same material as pipe 600. The end of pipe 600 opposite to nozzle 482 is connected to a source of high pressure water, such as diverter valve 102 (FIG. 1) or directly to a high pressure pump (since intermittent operation is not usually desirable here), by a quick connector coupling 607 and the flexible high pressure hose 629.

Shroud 602 of section 581 (the longest) is clamped to trolley 586 by a pair of brackets 606,606 and shroud 602 of section 585 (the shortest) is clamped to a jacket 608 mounted on a frame 610 of cart 580. The clamping action between jacket 608 and shroud 602 of section 585 is provided by a pair of clamping screws having quick release knobs 612,612 so that these clamping screws are operable by hand to adjust the angle of nozzle 482 relative to the horizontal. This angle is designated as angle A in FIG. 17 and sets the angle of attack of the high pressure water streams relative to drum surface 560. The angle A is preferably set so that the nozzle axis N makes an angle of about 90° with an imaginary line tangent to drum surface 560 where it is immediately opposite the spinning head 500 of nozzle 482. With the setup shown in FIGS. 14 and 15 for the perforated steel drums of a Fleissner dryer, the angle A is preferably in the range of about 35° to 40°.

Figure 19:
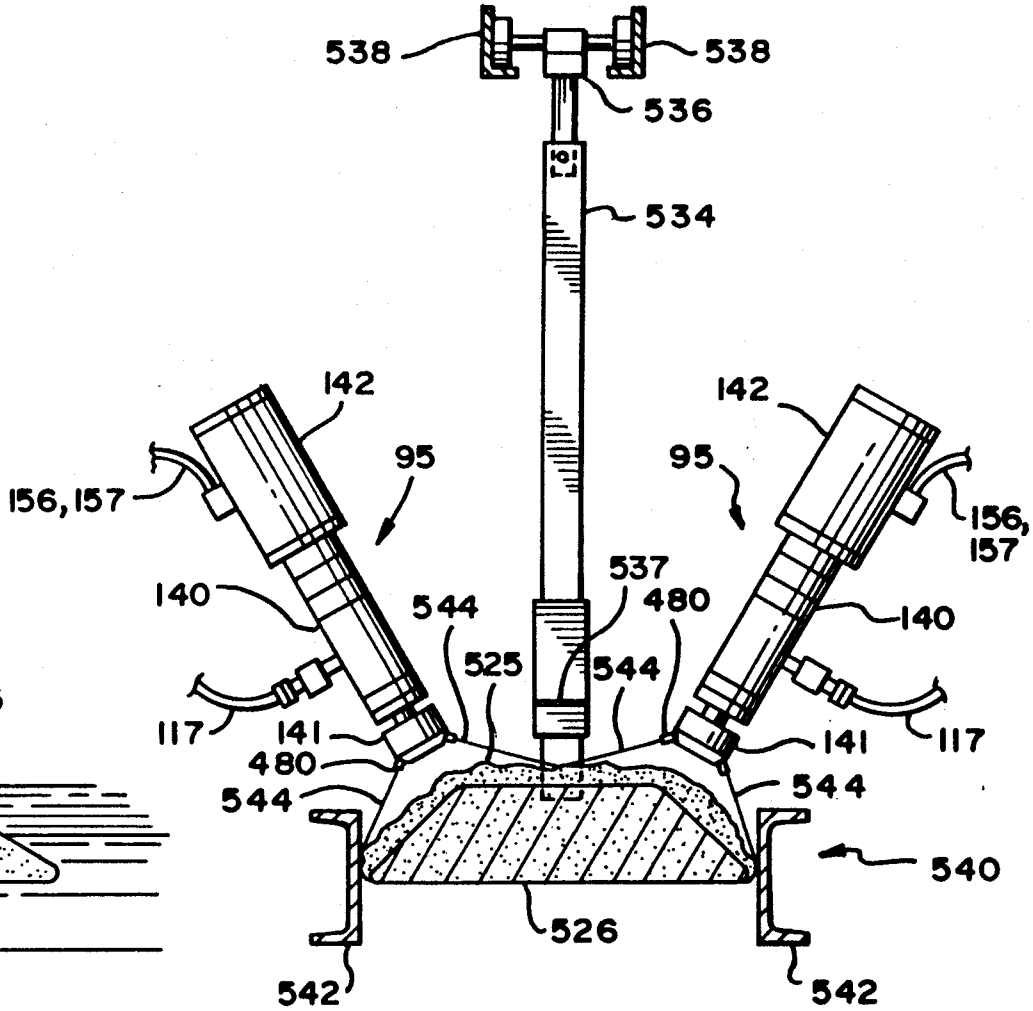
FIG. 19 is a bottom view of the drive trolley of FIG. 18.
Figure 18:
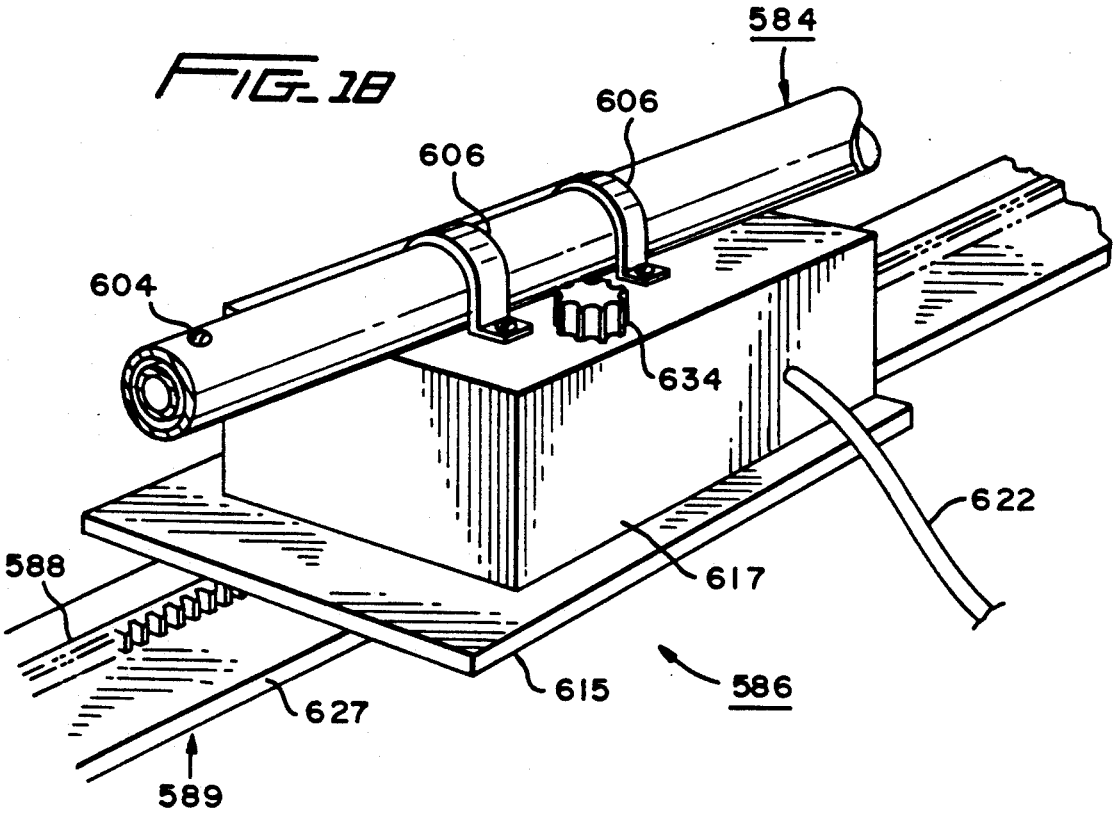
FIG. 18 is a fragmentary perspective view showing the drive trolley of the modification of FIG. 14.
Figure 19:
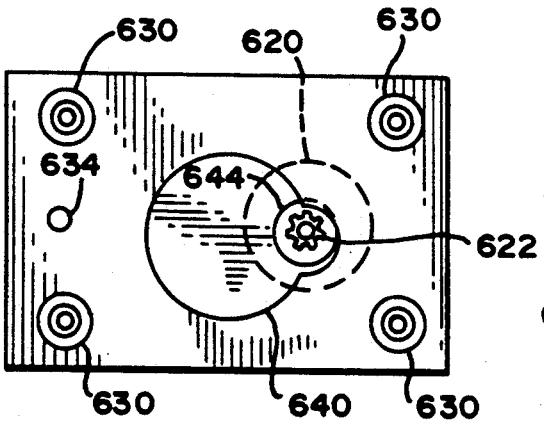
Figure 20:
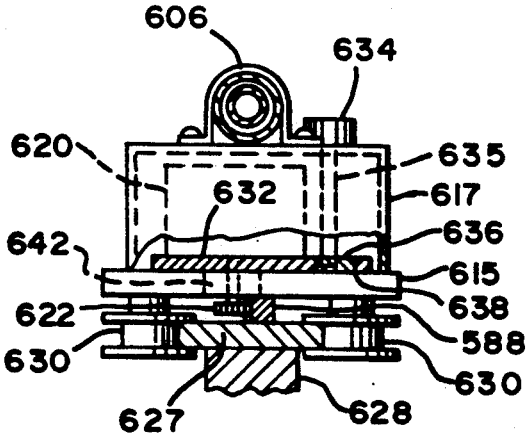
FIG. 20 is an elevational view in partial section of the drive trolley of FIG. 18.

As shown in FIG. 18, trolley 586 comprises a base plate 615 carrying a housing 617 to the top of which is bolted the conduit assembly 584 by the clamping brackets 606,606. Referring now to FIGS. 19 and 20, housing 617 contains a variable speed, reversible electric motor 620 which is connected by electrical lines 622 to a control panel 625 (FIG. 14). Motor 620 drives a pinion 622 which may engage rack 588 of track assembly 589 to move trolley 586 back and forth along the track assembly. Track assembly 589 includes a bed plate 627 for horizontally supporting rack 588, and bed plate 627 in turn is supported by a beam 628 each end of which is connected to a corresponding one of the stands 590. Rotatably mounted on base plate 615 of trolley 586 are two pairs of rollers 630 and 631, and one of each of these pairs engages an opposite side of bed plate 627 to support and guide trolley 586 for movement back and forth along track assembly 589.

A clutch assembly is provided for causing pinion 622 to be either engaged with or disengaged from rack 588. This clutch assembly comprises a sliding plate 632 on which motor 620 is mounted and which is arranged for sliding movement relative to housing base plate 615 around a pivot connection between plates 615 and 632 as provided by a pivot pin 634 (FIG. 19). The actuation of pivotal movement between plates 615 and 632 is provided by a hand operated knob 634 on the upper side of housing 617 and connected by a shaft 635 to an off center position of a cam element 636, which is received within an aperture 638 in sliding plate 632. A center portion of housing base plate 615 is cut out at 640 so as to provide for horizontal movement of the drive shaft 642 through which pinion 622 is driven by motor 620. A cut out 644 is also provided in sliding plate 632 to allow passage of motor drive shaft 642. Accordingly, the turning of knob 634 causes rotation of off-center cam 636 to thereby move pinion 622 laterally into and out of engagement with the teeth of rack 588.

Referring again to FIG. 14, control panel 625 replaces control panel 250 of the embodiment of FIG. 1 and comprises a three position toggle switch 650 which provides for forward movement, reverse movement and stopping of trolley 586. Start and stop switches 652 and 653, respectively, are connected via an electrical cable 655 to a high pressure water pump (not shown) arranged to supply city water to hose 629 at high pressure. Alternatively, start and start switches 652 and 653 may be connected by cable 655 directly to feed pump motor 86 and high pressure pump motor 40 of FIG. 1 so as to activate and deactivate these motors, respectively, since such direct operation of these motors for the embodiment of FIGS. 14–20 is more practicable than for the embodiments of FIGS. 1–13 because the latter involve assembly line operations requiring frequent interruption of the cleaning water streams to conserve water when a workpiece is not in front of the array of high pressure nozzles.

Control panel 625 also includes a fuse 657 and a running light 658, as well as a rheostat 660 for adjusting the speed at which trolley 586 and nozzle cart 580 are driven along their respective tracks. The speed of trolley motor 620 is thereby adjusted to select the desired speed of nozzle movement past the surface of dryer drum 560 relative to the rotational speeds of both nozzle head 500 and drum 556, the latter being rotated by its motor 566 which also may be an adjustable speed motor.

In the preferred arrangement for cleaning Fleissner dryer drums, the tips of the rotating head of nozzle 482 are positioned about ½ inch away from surface 560 and the nozzle head is sized to provide a cleaned area approximately 3 inches in diameter at this distance. Each of the drums 556 are about 8.5 ft. in diameter and therefore have a circumference of about 28 ft., and may be rotated by motor 566 at a speed equivalent to 51 linear ft. of drum surface per minute. For this specific application, the speed of motor 620 is set by rheostat 660 such that trolley 586 advances nozzle 482 at about 5 inches per minute to provide a spiral cleaning path around the drum surface that advances to remove coating 576 from drum surface 560 at a rate of about 1.5 inches of axial advance per turn of the drum, broken line 670 illustrating the spiral path of nozzle 482 along surface 560 as produced by rotation of the drum relative to linear movement of nozzle cart 580.

Air Nozzle System

Figure 21:
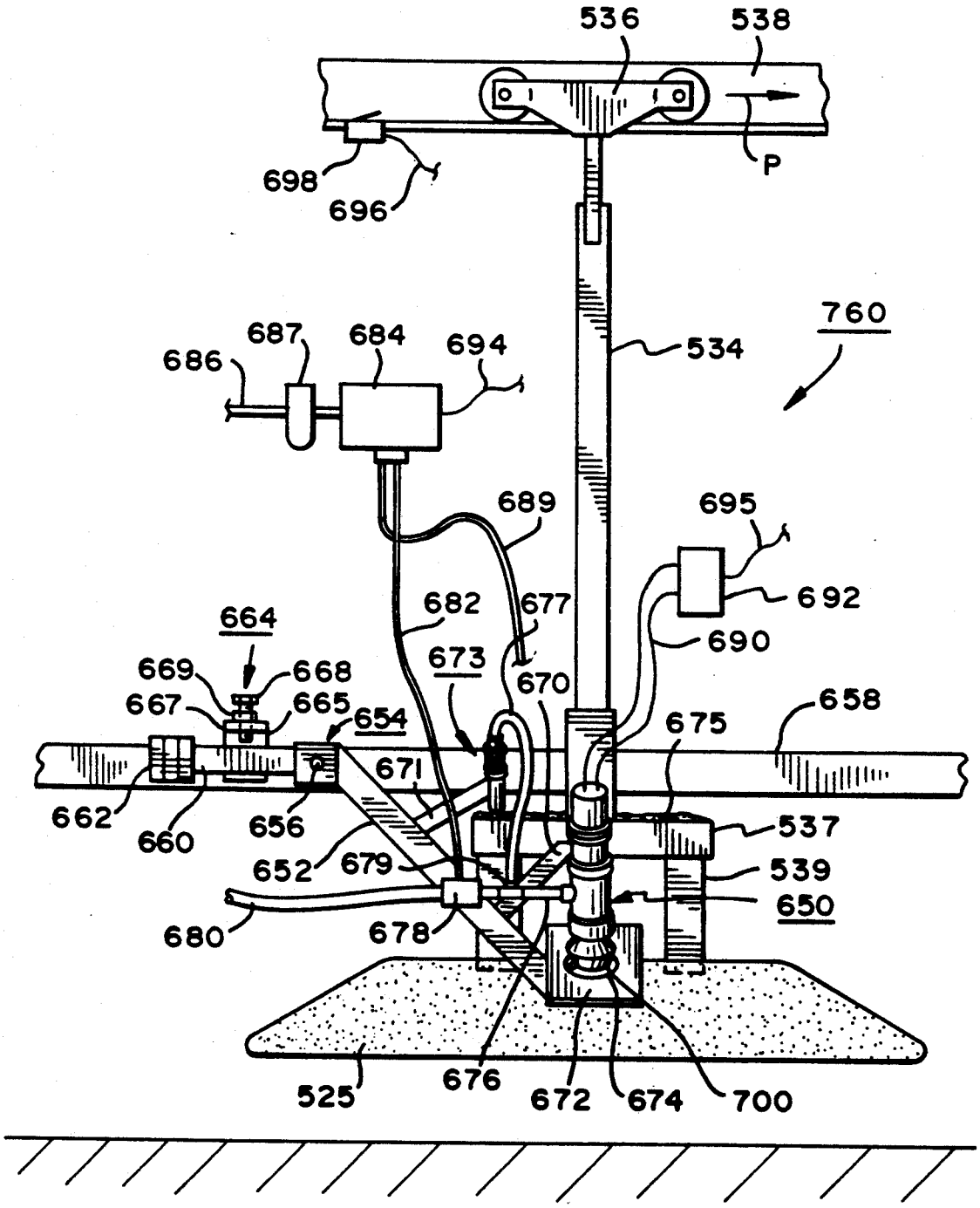
FIG. 21 is a side elevational view of the electrode of FIG. 12 being cleaned by a motorized air nozzle and an auxiliary air nozzle in accordance with a modification of the invention.

As has been indicated previously, gaseous fluids may be substituted for liquid fluids in many applications of the present invention. Referring now to FIG. 21, there is shown a nozzle system for using substantially solid streams of air to cut bath deposits from a metal refining anode. An air nozzle, generally designated 650, is mounted on the forward arm portion 652 of a floating arm 654 pivotally mounted at 656 on a supporting beam 658. At the aft end of a rear arm portion 660 is a counterweight 662 for counter balancing the weight of the nozzle assemblies mounted on forward arm portion 652. A stop mechanism 664 is also mounted on beam 658 adjacent to rear arm portion 660 and this stop includes an angle iron having a vertical leg 665 welded to beam 658 and a horizontal leg 667 extending over rear arm portion 660. A threaded bolt 668, which is threaded through a lock nut 669 and a threaded aperture in leg 667, provides an adjustable stop for engaging the upper surface of rear arm portion 660 thereby providing means for adjusting the distance at which air nozzle 650 is normally stopped relative to the travel path of anode body 526.

Nozzle assembly 650 is supported on forward arm portion 652 by a lateral support 670, and mounted at the lower end of forward arm portion 652 is a bumper plate 672, which prevents the spinning nozzle head 700 from hitting against the bath deposits on anode body 526 as the coating 525 formed by these deposits may be of widely varying thickness. Bumper plate 672 has an opening 674 therein which is positioned relative to spinning nozzle head 700 so as to permit passage of the ejected air streams for impact against the coated anode body without plate 672 interfering with either the shape or the velocity of these air streams. A duplicate of nozzle 650 and arm 654 is also mounted on the opposite side of beam 658 so that a pair of air cleaning nozzles is positioned relative to anode body 526 in the same manner as the pair of water nozzles 95,95 shown in FIG. 13.

Also mounted on forward arm portion 652 by a second lateral support 671 is an auxiliary air nozzle assembly 673 for removing a layer of bath deposit debris 675 from the upper surface of transverse bar 537 of the anode support. Auxiliary assembly 673 is connected to the pressurized air source via a flexible air hose 677 which is connected to a T member 679 in air conduit 676. In the application shown, the nozzle assembly 673 may be omitted from the air cleaning assembly on the opposite side of beam 658 because a single nozzle assembly is sufficient to clean the upper surface of bar 537, which in this application is only about 4 inches wide.

Nozzle assembly 650 is connected to a source of pressurized air (not shown) through an air conduit 676, a normally closed air shut off valve 678 and a flexible hose 680. By way of example, pressurized air may be supplied at 150 psi from a 500 gallon receiver tank (not shown) through a 2 inch air hose 680. Valve 678 is preferably an air actuated AQUAMATIC valve which is caused to open in response to air pressure in an air control line 682 fed from a solenoid actuated control valve 684 which is provided with control air through an air supply line 686 having therein a filter/oiler 687. Air supply line 686 may be connected to the same source of air as main air line 680. Valve 684 is preferably a VERSA valve actuated by a 110 volt solenoid. A second air control line 689 goes to the AQUAMATIC valve of the nozzle assembly (not shown) on the opposite side of beam 658, which is identical to the nozzle assembly shown in FIG. 21.

The motor of nozzle assembly 650 is operated and controlled by an electrical cable 690 which connects the motor to a motor controller 692. Both air control valve 684 and motor controller 692 are connected via electrical line 694 and 695, respectively, to a Production Line Computer (PLC) which is not shown. Also connected to the PLC via electrical line 696 is a limit switch 698 which is engaged by trolley 536 as it moves the anode in the direction of arrow P to initiate a timing cycle controlled by the PLC. In response to this timing cycle, the nozzle motor is first actuated and then deactuated, and shut off valve 678 is first opened and then closed to operate the air nozzles in intermittent fashion. In this manner, the air nozzles are actuated only while the anode body 526 is in the cleaning station 760 served by these nozzles.

Motor-Actuated Air Nozzle Assembly

Figure 22:
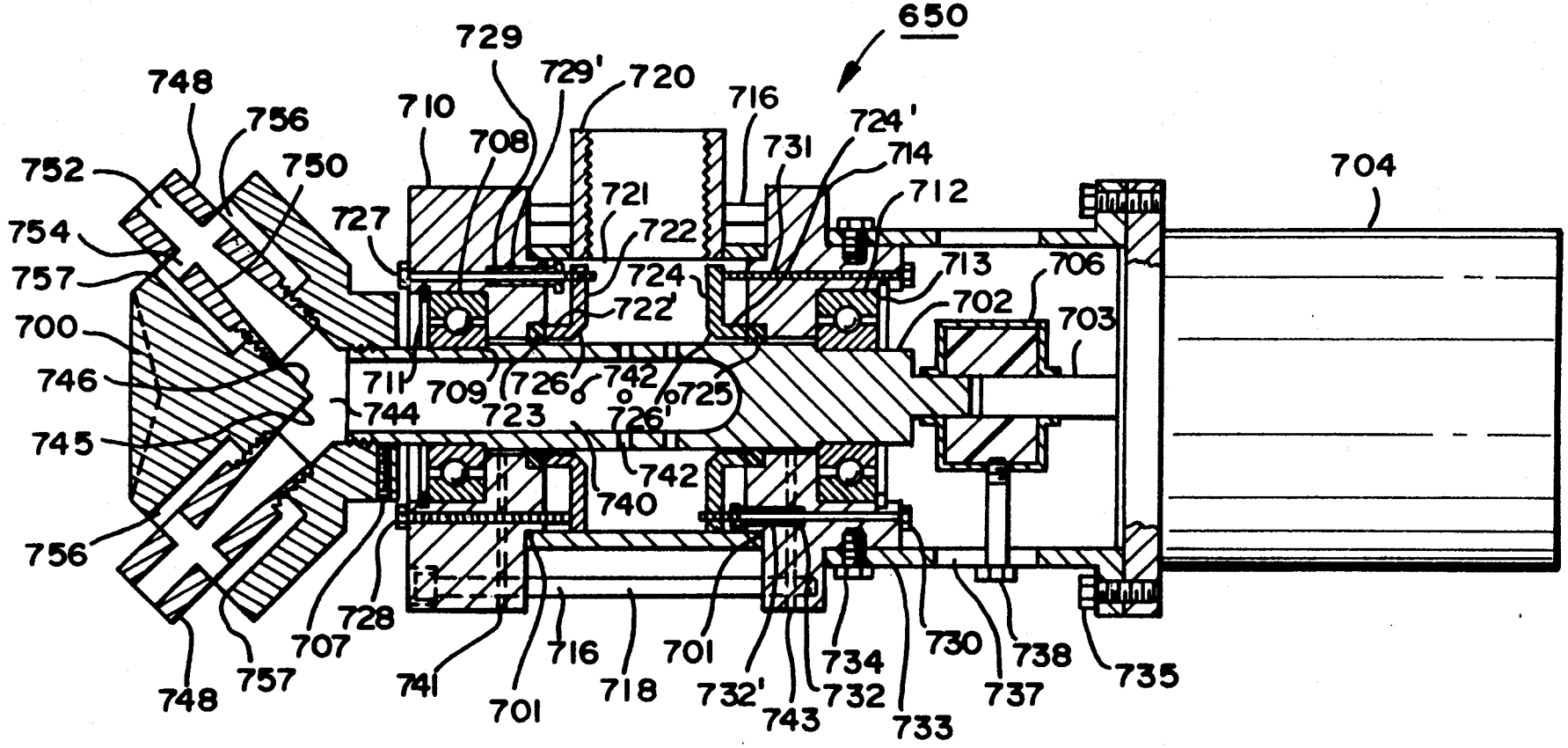
FIG. 22 is a sectional view of the motorized air nozzle of FIG. 21.

Referring now to FIG. 22 which shows a cross-section of nozzle assembly 650. Spinning nozzle head 700 is driven by a drive shaft 702 which is connected to a shaft 703 of a reversible electric motor 704 by a flexible coupling 706, preferably of the type manufactured by Lovejoy Manufacturing Company. Head 700 is preferably threaded on the outer end of shaft 702 by National Pipe Threads (NPT) which provide a locking taper, a set screw 707 being provided so that head 700 may be spun in either direction by motor 704. Shaft 702 is mounted for rotation by a forward bearing 708 and a rear bearing 712, front bearing 708 being held in a front end cap 710 by a split ring 711 and rear bearing 712 being held in a rear end cap 714 by a split ring 713. Clamped in position between front end cap 710 and rear end cap 714 by a plurality (preferably 4) of cap screws 716 is a cylindrical body 718 defining an inlet air chamber 721 which is connected to air hose 767 (FIG. 21) by an air inlet nipple 720. O-ring seals 701,701 are provided between the respective ends of nozzle body 718 and end caps 710 and 714 to seal air chamber 721.

Also for retaining air in inlet chamber 721, there are provided around shaft 702 a forward packing ring 723 and a rear packing ring 725, both rings preferably being made of graphite. Forward packing ring 723 is held in position by a gland plate 722 having a forwardly projecting pressure annulus 722' for adjustably applying pressure to packing ring 723 in response to the tightening of a plurality (preferably 3) of pulling screws 727. A plurality of pushing screws (preferably 3) are used to limit the pressure which may be applied against packing ring 723 by tightening of the pulling screws 727. Pulling screws 727 pass through an O-ring seal 729 which is held in position and caused to sealingly engage a smooth portion of the pulling screw shaft by means of a retainer sleeve 729', which is freely slidable in its socket so as to be pushed forward by the air pressure in inlet chamber 721.

Similarly, a rear gland plate 724 having a rearward projecting annulus 724' is caused to apply pressure against packing ring 725 in response to the tightening of a plurality of pulling screws 730 which pass through an O-ring seal 732 held in position and pressed into sealing engagement with a smooth portion of the screw shaft by a freely movable retainer sleeve 732'. A plurality of pushing screws 731 limit the pressure which may be applied against packing ring 725 by the tightening of pulling screws 730. A plurality (preferably 2) of forward weep holes 741 and a plurality (preferably 2) of aft weep holes 743 allow any air passing the packing ring adjacent thereto from creating sufficient pressure to blow out the lubricant from the corresponding set of bearings, each of which is preferably of the sealed bearing type.

A motor adapter cylinder 733 is secured to rear end cap 714 by a plurality of bolts 734 and to motor 704 by a plurality of bolts 735. Adapter cylinder 733 contains an aperture 737 for receiving a locking bolt 738 which is shown in broken lines because it is only secured to coupling 706 when it is desired to lock shaft 702 in a fixed position for maintenance or removal of spinning head 700 and related components.

High pressure air entering chamber 721 through nipple 720 passes from chamber 721 into an axial conduit 740 in shaft 702 through a plurality of apertures 742. There are preferably a total of 12 apertures arranged in four rows of three apertures each, the rows being spaced circumferentially around shaft 702 at 90° intervals and adjacent rows being offset from each other as illustrated in FIG. 22. This circumferential spacing and axial offsetting of rows 742 substantially eliminates the imposition of any radial thrusts by the air entering conduit 740, such as would be caused by air entering a single aperture and impacting against an opposing wall of the shaft before traveling down the axial conduit.

Air travelling forward down conduit 740 is discharged into a central head chamber 744 from which it is fed by passages 445 and 446 to a pair of nozzle tips 748,748, each preferably positioned in a plane which also passes through the spin axis and at angles relative to spin axis in the range of 20° to 70°, more preferably 30° to 60°, and most preferably at about 45°. Each nozzle tip is preferably threaded in its corresponding passage in spinning head 700 by NPT threads which have a locking taper. Although two tips are preferred, one or three or more nozzle tips may be similarly mounted on spinning head 700 as desired. Gland plates 722 and 724 are tapered at 726 and 726', respectively, to insure unrestricted entry of air from inlet chamber 721 into those apertures at the end of each of the respective axially extending aperture rows.

Each nozzle tip 748 has an upstream tapered bore 750 and a downstream straight bore 752, the diameter (e.g., 5/16 inch) of the straight bore being sufficiently larger than the diameter (e.g., ¼ inch) at the discharge end of the tapered bore for primary air from the tapered bore to create a venturi suction force which sucks a substantial mass of secondary air through lateral air ports 754. This secondary air is then mixed with the primary air in straight bore 752 and the combined mass of secondary air and primary air are dis through the orifice opening at high velocity (e.g., 600–1,200 feet per second).

The diameter of each counter bore 756,756 is sufficiently larger than the outside diameter of the corresponding nozzle tip 748 so that air is free to enter the nozzle tip through the one or more lateral air holes 754. However, the entrance to each lateral air holes 754 is either even with (as shown in FIG. 22) or slightly below the lip of counter bore 756, and the diameter of counter bore 756 relative to the outer diameter of nozzle tip 748 is such that a filtering action is achieved which prevents airborne particulates from entering lateral air holes 754 where those particulates are sufficiently large to cause clogging of these passages. Accordingly, the radial distance between the outer surface of nozzle tip 748 and counter bore lip 757 is preferably less than the diameter of lateral air holes 754. There are preferably six air holes of ⅛-inch diameter in each nozzle tip 748.

By way of example, spinning head 700 and O-ring retainers 729' and 732' may be made of 6061 aluminum, shaft 702 may be made of 17-4 PH steel and may have a hardened surface or a hard surface coating such as tungsten carbide, and all of the remaining metal parts may be made of 303 stainless steel. Graphite packing rings 723 and 725 may be ¼ inch thick and may have a 1½ inch outside diameter and a 1 inch inside diameter. Air inlet nipple 720 may have a 2 inch inside diameter and their apertures 742 may have a ¼ inch diameter. Nozzle body 718 may be 3 inches long and 4 inches in diameter. End caps 710 and 714 may be 5½ inches in diameter and the overall length of nozzle assembly 650 may be about 18 inches. Motor adapter 733 may be 6 inches long and 4½ inches in diameter, an opening 737 therein may be 2 inches by 2 inches square to allow sufficient access to service coupling 706 without disassembling adapter 733.

Motor 704 may be a three-quarter horsepower D/C motor and is preferably of the variable speed type capable of up to 2,000 rpm. Air nozzle motor 704 and water nozzle motor 142 both are preferably of the type which may rotate in either direction. This is desirable because in the lateral positioning of a pair of these nozzles as mirror images of each other, such as illustrated in FIG. 13 for the cleaning of anodes, it is preferably that the spinning heads of the respective assemblies rotate in opposite directions so that the debris from the removed coating is effectively blown in the same direction. For example, with either air or water nozzles positioned as the water nozzles 95,95 in FIG. 13, it is preferably that the right nozzle head rotate in the clockwise direction as viewed from its motor and that the left nozzle head rotate in the counterclockwise direction as viewed from its motor so that removed pieces of the coating 525 are blown into the page of FIG. 13, which represents the direction from which anode body 526 is entering the workstation 540.

Air Blast Nozzle Assembly

Figure 23:
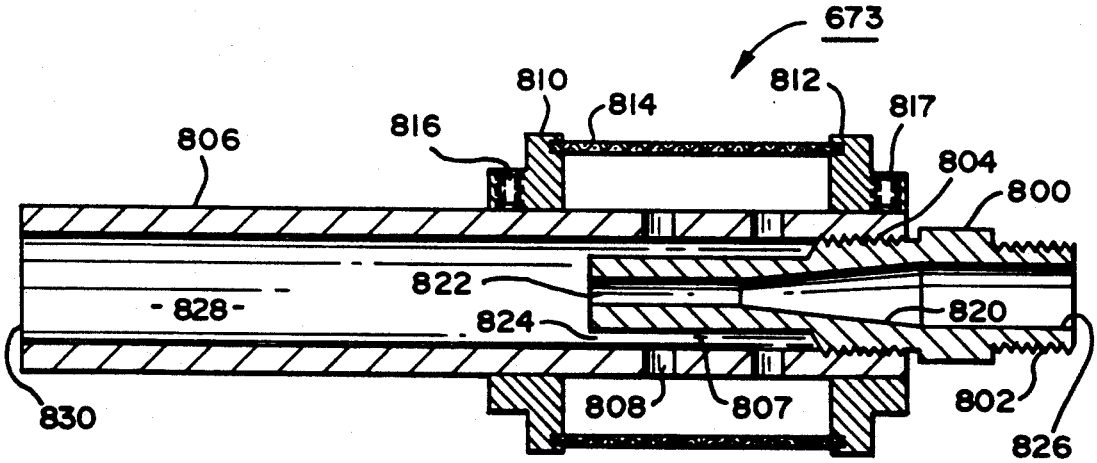
FIG. 23 is a sectional view of the auxiliary air nozzle of FIG. 21.

Referring now to FIG. 23, there are shown the details of the air blast nozzle, generally designated 673 in FIG. 21, for removing loosely adhered bath deposits 675 and other debris which may settle on the upper surface of electrode cross bar 537 during use and/or subsequent handling, such as mechanical cleaning, of carbon anode body 526. Blast nozzle 673 comprises an air nozzle 800 which is connected by threads 802 to a threaded coupling at the end of air hose 677 (FIG. 21). Nozzle 802 is secured by a NP Threads to a barrel 806 having a diameter larger than a tip portion 807 of nozzle 802 and lateral passages 808. To prevent air passages 808 from becoming clogged with bath dusts and other airborne debris, these passages are surrounded by a cylindrical screen 814, one end of which is secured to barrel 806 by an annular disk 810 having a set screw 816, and the other end of which is secured to barrel 806 by an annular disk 812 having a set screw 817.

Nozzle tip 807 has a tapered bore 820 upstream of a straight bore 822 and these bores focus the high pressure air entering nozzle 802 through inlet passage 826. The focused air stream, which leaves bore 822 at high velocity, creates a strong suction force in the chamber annulus 824 and this suction force sucks a high flow rate of auxiliary air into barrel chamber 828 through lateral passages 808. The correspondingly large flow rate of auxiliary air in a mixture with primary air is then discharged from barrel opening 830 and against the workpiece, whereupon the discharged air dislodges and blows away the loosely adhered coating 675 on the upper surface of anode cross bar 537 (FIG. 21).

By way of example, nozzle 800 and screen 814 may be made of stainless steel, and barrel 806 and disks 810 and 812 may be made of 6061 aluminum. Straight bore 822 preferably has a 5/16 inch diameter and barrel 806 preferably has an inside diameter of ¾ inch and contains 16 lateral air passages 808 each 5/16 inch in diameter. Threads 802 and 804 each are preferably of the NPT type and have a nominal diameter of about ½ inch.

Gas Cleaning of Electrodes

In many cleaning applications, the motorized air nozzles of the invention may be used to remove moderately adhered coatings on a substrate. This air cleaning system also may readily replace many mechanical abrasion or impact systems of the prior art, and in many instances may be preferred over a water cleaning operation using the water nozzles 95,95 of FIG. 1 because the air nozzles involve a reduced number of components and a simplified arrangement thereof, are less expensive to assemble and operate, and maintain a dry environment where liquids may be undesirable.

Thus, the air cleaning system of FIG. 21 may be sufficient as the sole anode cleaning operation or may be used as one of several cleaning operations, such as in combination with a subsequent water cleaning operation as shown in FIG. 13, or a preceding mechanical cleaning operation (e.g., impacting with steel shot or the like). The motor-actuated high pressure air nozzles of the invention are especially effective in removing unvitrified bath deposits from the metal refining anodes of FIGS. 12 and 13 because these deposits are only moderately adhered to body 526 of the electrode as compared to those bath deposits which have been vitrified by long exposure to the high temperatures to which these electrodes may be subjected during metal refining operations.

The "focused" nozzle tips used on the spinning head of the air nozzles have larger diameter passageways than those of the water nozzles to accommodate the larger volumes of air ejected by the air nozzle tips. A pair of these air nozzles may be mounted at an Aar cleaning station 760, with one nozzle mounted on either side of the anode in the same manner as the water nozzles 95,95 at water cleaning station 540 (FIG. 13), one air nozzle using the mounting arm structure of FIG. 21 and the other using a mounting arm structure that is the mirror image of the one shown. As is station 540, station 760 is on an assembly line for processing spent anodes for recovery of the useful parts thereof, including the residual carbon and its copper support structure. The air pressure employed in such a cleaning operation is preferably in the range of 90 to 180 psi, more preferably 140 to 160 psi, and most preferably about 150 psi. The air nozzle orifices and related passageways in the air nozzle housing and the spinning head are sized to discharge air at a rate in the range of 250 to 1,000 cubic ft. per minute, preferably 500 to 900 cubic ft. per minute.

In the same fashion as for the water nozzles, the tips of the air nozzles are preferably canted radially outward at an angle of about 45° relative to the spin axis, and the nozzle head is rotated by an appropriate power source, such as a variable speed D/C motor. The speed of rotation is preferably about 50–500 rpm, more preferably about 100–150 rpm. Like the water nozzles at station 540, the air nozzles at station 760 are tilted in opposite directions from the vertical and preferably are laterally offset along the travel path of the workpiece, and the spinning heads are rotated in opposite directions to blow removed debris back up the travel path in the direction opposite to arrow P (FIG. 21). Because the passage of air through the nozzle tips is much less erosive than the passage of water, the air nozzle tips may be made of stainless steel, such as 17-4 PH stainless steel, instead of a harder carbide type of material.

Although the air cleaning operation just described may be the sole fluid cleaning operation, it also may serve as a pre-cleaning operation at a workstation ahead of the water cleaning work- station of FIG. 1. The advantages provided by pre-cleaning bath coated anodes with air nozzles are at least two-fold. First, the focused air streams provided by the air nozzles of the invention may alone be sufficient to remove all of the bath deposits where none of these have remained in the furnace long enough to become strongly adhered to an anode surface or where vitrified deposits have been loosened by an earlier mechanical impact operation, thus eliminating the necessity of passing such anodes through the water cleaning station 540.

Second, even where strongly adhered deposits require subsequent passage through the water cleaning station, the water cleaning operation is speeded up significantly by the absence of an outer coating of moderately adhered bath deposits. For example, in one test where pre-cleaning was not employed, a residence time of 10 seconds was required for the body of one anode to pass through water cleaning station 540. By comparison, an air nozzle pre-cleaning operation decreased the residence time of the anode at the water cleaning station to about 6 seconds, resulting in significant savings in water usage and reducing the amount of water in the waste to be handled. Also, ejected air streams generally diverge more rapidly than ejected water streams so that the cleaning patterns of air nozzles are able to cover a larger cleaning area. The air nozzles at an air cleaning station therefore may be actuated for a shorter period of time than water nozzles, such as a 4 second actuation of the air nozzles compared to a 6 second actuation of the water nozzles for a workpiece traveling at the same speed.

Although the present invention has been described with reference to the particular embodiments thereof, it will be understood by those skilled in the art that modifications may be made without departing from the scope of the invention. Accordingly, all modifications and equivalents which are properly within the scope of the disclosure presented in this specification are included in the present invention.

What is claimed is:

1. An apparatus for removing a coating from a surface of a substrate to which the coating is adhered as said substrate travels along a path through a work station, said apparatus comprising:

body means defining a chamber for receiving a pressurized fluid;

means for connecting said body chamber to a source of said pressurized fluid when said substrate enters said work station and disconnecting said body chamber from said fluid source when said substrate leaves said work station;

head means;

means for mounting said head means on said body means for rotation about a spin axis;

at least one nozzle tip mounted on said head means and having a bore for receiving said pressurized fluid, and an orifice opening at an end of said bore for discharging said pressurized fluid along an axis of said orifice opening and against said coating as at least part of a focused stream of fluid having a velocity sufficient to remove from said substrate surface such portions of said coating as are impacted by a core portion of said stream;

means for conveying said pressurized fluid from said body chamber to said nozzle tip bore;

means for causing said head means to spin about said spin axis at least while said pressurized fluid is being discharged from said at least one nozzle tip, said orifice being positioned such that said spinning of the head means causes the core portion of said focused stream to provide an annular fluid pattern for cleaning an annular path through said coating when said body means is stationary relative to said substrate and a linear path through said coating when said body means and said substrate are moved linearly relative to each other in a direction lateral to said spin axis, the width of said annular path corresponding to a transverse dimension of said core portion and the width of said linear path corresponding to a transverse dimension of said annular fluid pattern; and, means for mounting said body means such that said spin axis is substantially perpendicular to at least a portion of said substrate surface when said substrate is opposite to said head means, said mounting means providing for lateral movement of said body means in a direction toward and a direction away from said travel path through the work station such that said head means is maintained at a predetermined distance from the coating on said substrate surface irrespective of changes in a lateral dimension of the coated substrate, said predetermined distance being such that said core portion of the stream is effective to remove impacted portions of said coating from said substrate surface, and said body mounting means comprising:

an arm member;

means for supporting said arm member for pivotal movement around a pivotal connection;

means for mounting said body means on said arm member;

and bumper means for engaging an outer surface of said coating, said bumper means being mounted on said arm member in spaced relation to said body means such that said engagement causes said arm member to pivot around said pivotal connection and thereby maintain said head means at said predetermined distance from said coating.

2. An apparatus according to claim 1 wherein said head mounting means includes a shaft member mounted for rotation in said body means, wherein two of said nozzle tips are mounted on said head means on opposite sides of the rotational axis of said shaft member, and wherein the orifice axis of each of said nozzle tips is positioned substantially within a axial plane of the spin axis and canted radially outward at an angle of at least 30° relative to said spin axis for the core portion of said stream to undercut said coating.

3. An apparatus according to claim 1 wherein said rotation means comprises a motor and means for connecting said head means to a drive shaft of said motor.

4. An apparatus according to claim 1 wherein said head mounting means comprises a shaft member rotatably mounted in said body means and thrust bearing means opposing axial movement of said shaft member in at least one axial direction, wherein two of said nozzle tips are mounted on said head means on opposite sides of the rotational axis of said shaft member, and wherein said spinning means comprises means for mounting said nozzle tips on said head means so that the orifice axes of said nozzle tips are canted in opposite directions relative to said spin axis such that the discharge of said pressurized fluid provides a reaction force out of an axial plane of the spin axis, said reaction force being sufficient to cause said head means to spin.

5. An apparatus according to claim 1, wherein said head mounting means comprises a shaft member rotatably mounted in said body means, and wherein said fluid conveying means comprises an axial chamber extending along the rotational axis of said shaft member, fluid communication between said axial chamber and said body chamber being provided by at least one pair of lateral passages positioned opposite to one another such that fluid passing from said body chamber into said axial chamber through said opposite lateral passages imposes no substantial net radial thrust on said shaft member.

6. An apparatus according to claim 5 wherein said head mounting means further comprises compressible packing means around said shaft member in axially spaced relation to opposites sides of said lateral passages, and means is provided for compressing said packing means such that said packing means engages the surface of said shaft member to prevent fluid in said body chamber from escaping in either direction along said body shaft member.

7. An apparatus according to claim 6 wherein said head mounting means further comprises bearing means for rotatably mounting said shaft member in said body means, said bearing means engaging said shaft member in axially spaced relation to opposite sides of said packing means away from said lateral passages.

8. An apparatus according to claim 1 wherein said connecting means includes valve means for intermittently connecting said body chamber to said pressurized fluid source, and said rotation means includes means for intermittently rotating said head means such that said annular fluid pattern is provided only when said substrate is at said work station in which said coating is to be impacted by said pattern.

9. An apparatus according to claim 1 wherein said fluid is a liquid, said connecting means connects said body chamber to pump means comprising a high pressure positive displacement pump, and said connecting means includes valve means for intermittently connecting said body chamber to said pump means, said valve means comprising:

a rotary valve member having a first position for directing pressurized liquid to said body chamber and a second position for directing said pressurized liquid to ambient pressure;

at least one piston means connected to said valve member for movement therewith as said valve member moves between said first and second positions; and cylinder means for selectively applying a pressure medium to either side of said piston means such that said piston means causes said valve member to selectively rotate between said first and second positions so that said pump means may be operated continuously while pressurized liquid is being supplied intermittently to said body chamber.

10. An apparatus according to claim 9 wherein said apparatus further comprises means for automatically stopping said pump means in response to a sensed condition selected from the group consisting of excessive temperature of said pump means, excessive pressure at a discharge header of said pump means, inadequate pressure at an inlet header of said pump means, and two or more of said sensed conditions.

11. An apparatus according to claim 1 wherein said pressurized fluid is a primary gas and said nozzle tip has at least one lateral port for providing fluid communication between said bore and a source of secondary gas, said bore having a straight section of a substantially uniform first diameter immediately upstream of an orifice opening, and a tapered section upstream of said straight section, said tapered section having a second diameter in the vicinity of said lateral port(s)

less than said first diameter such that when said primary gas passes through said bore a suction force is created which draws said secondary gas through said lateral port(s) and into said bore to be discharged through said orifice opening with said primary gas.

12. An apparatus according to claim 1 wherein said nozzle tip bore has a straight section of substantially uniform diameter immediately upstream of said orifice opening and a tapered section upstream of said straight section, wherein said tapered section has a wall tapered at an angle relative to a center axis of said bore in the range of 5° to 30°, wherein the ratio of the axial length of said tapered section to the axial length of said straight section is in the range of 3.0 to 8.5 and wherein the ratio of the length to the diameter of said straight section is 1.0 to 4.0.

13. An apparatus according to claim 12 wherein said fluid is a liquid, said tapered length to straight length ratio is in the range of 3.3 to 7.5, and said length to diameter ratio of the straight section is in the range of 1.25 to 3.0.

14. An apparatus according to claim 12 wherein said fluid is a gas, said tapered length to straight length ratio is in the range of 3.0 to 4.0, and the length to diameter ratio of said straight section is in the range of 1.5 to 3.0.

15. An apparatus according to claim 1 wherein said pressurized fluid is a liquid and said apparatus further comprises means for collecting at least a portion of said coating and a portion of said discharged fluid after removal of said coating from said surface, and means for separating said fluid portion form said coating portion and recirculating said fluid portion to said source of pressurized fluid, said separating and recycling means including filter means for separating said fluid portion from said coating portion.

16. A method of using four of the apparatuses according to claim 1 to remove a coating of scale adhered to the surface of a metal billet, said method comprising positioning four of said body means in spaced relation around said path along which said billet is to be moved such that the fluid pattern provided by rotation of the head means of each of said body means will impact against a corresponding one-fourth of the circumference of said billet with sufficient force to remove said scale when said head means is rotated and said billet is moved along said path, and causing said billet to move along said path at a predetermined linear speed and said head means to rotate at a predetermined rotational speed such that the fluid patterns provided by said four apparatuses remove substantially all of said coating from said billet surface.

17. A method of using two of the apparatuses of claim 1 to remove a coating of electrolytic bath deposits adhered to the surfaces of opposite side portions of an electrode component removed from an electrolytic bath, said method comprising positioning two of said body means in spaced relation on opposite sides of said path along which said component is to be moved such that the fluid pattern provided by rotation of the head means of each of said body means will impact against a corresponding one of the side portions of said component with sufficient force to remove said deposits when said head is rotated and said component is moved along said path, and causing said electrode to move along said path at a predetermined linear speed and said head means to rotate at a predetermined rotational speed such that the fluid patterns provided by said two apparatuses remove substantially all of said coating from said side surfaces of said component.

18. An apparatus according to claim 1 wherein said body means and said bumper means are mounted so that the weight thereof biases at least a portion of the arm member in one of said directions of lateral movement, and wherein said body mounting means further comprises means for biasing said portion of the arm member in the other of said directions of lateral movement to at least partially counterbalance the weight of said body means and said bumper means.

19. An apparatus according to claim 18 wherein said body means and said bumper means are mounted on said one portion of the arm member and said biasing means is mounted on another portion of the arm member, said one portion and said another portion of the arm member being on opposite sides of said pivotal connection.

20. An apparatus according to claim 18 wherein said body mounting means further comprises stop means for engaging said arm member to limit pivotal movement of said one portion of the arm member in the direction toward said travel path.

21. An apparatus according to claim 1 wherein said head mounting means comprises a shaft member rotatably mounted in said body means, wherein said fluid conveying means comprises an axial passage extending in the direction of the rotational axis of said shaft member and means providing fluid communication between said axial passage and said body chamber, and wherein said apparatus further comprises packing means positioned in said body means and arranged around said shaft member to inhibit leakage of said pressurized fluid from said body chamber along an exterior surface of said shaft member, and cooling means for providing auxiliary water at a pressure less than that of said pressurized fluid for cooling said body means and said packing means, said cooling means comprising at least one passage in said body means for providing a flow of said auxiliary water along a portion of said shaft member on a side of said packing means opposite from said body chamber.

22. An apparatus according to claim 1 wherein said head mounting means comprises a shaft member rotatably mounted in said body means; wherein said fluid conveying means comprises an axial passage extending in the direction of the rotational axis of said shaft member and means providing fluid communication between said axial passage and said body chamber; wherein said apparatus further comprises packing means having a compressible portion arranged around said shaft member to inhibit leakage of said pressurized fluid from said body chamber along an exterior surface of said shaft member, and means for compressing said packing means such that said compressible portion engages said exterior surface of the shaft member, said compressible packing portion comprising an annular member comprising intertwined graphite and carbon ropes, an annular member comprising graphite and positioned on one side of said rope member, and an annular member positioned on the other side of said rope member and comprising a relatively hard synthetic resin such as KEVLAR; and wherein said compressing means comprises a first hard annular member with one side adjacent to said graphite member, spring means engaging the other side of said first hard member, and a second hard member adjacent to said synthetic resin member.

23. An apparatus according to claim 1 wherein the cant of said orifice axis relative to said spin axis is such that the discharge of said pressurized fluid provides a substantial reaction force in an axial plane of said spin axis and said linear path width substantially exceeds twice the sum of said annular path width and any radial distance between said orifice opening and said spin axis.

24. An apparatus according to claim 1 wherein said spin means causes said head means to rotate at a speed of at least 2000 rpm.

25. An apparatus according to claim 1 wherein said bumper means comprises a plate member extending radially relative to said spin axis and positioned between said head means and said travel path, said plate member defining an opening for passage of said focused stream without interfering with either the shape or velocity thereof.

26. An apparatus according to claim 1 wherein said spinning means comprises means for mounting said nozzle tip on said head means so that the orifice axis of said nozzle tip is canted relative to said spin axis such that the discharge of said pressurized fluid provides a reaction force out of an axial plane of said spin axis, said reaction force being sufficient to cause said head means to spin.

27. An apparatus for removing a coating from a surface of a substrate to which the coating is adhered, said apparatus comprising:

body means defining a chamber for receiving a pressurized fluid;

means for connecting said body chamber to a source of said pressurized fluid;

head means;

means for rotatably mounting said head means on said body means;

at least one nozzle tip mounted on said head means and comprising a bore for receiving said pressurized fluid, an orifice opening at an end of said bore for discharging said pressurized fluid against said coating as at least part of a focused stream of fluid having a velocity sufficient to remove from said substrate such portions of said coating as are impacted by a core portion of said stream, and at least one lateral port for providing fluid communication between said bore and a source of secondary fluid, said bore having a straight section of a substantially uniform first diameter immediately upstream of said orifice opening and a tapered section upstream of said straight section, said tapered section having a second diameter in the vicinity of said lateral port(s) less than said first diameter such that when said primary fluid passes through said bore a suction force is created which draws said secondary fluid through said lateral port(s) and into said bore to be discharged through said orifice opening with said primary fluid;

means for conveying said pressurized fluid from said body chamber to said nozzle tip bore; and, means for causing said head means to rotate at least while said pressurized fluid is being discharged from said at least one nozzle tip, said orifice opening being positioned such that said rotation causes the core portion of said focused stream to provide an annular fluid pattern for cleaning an annular path through said coating when said body means is stationary relative to said substrate and a linear path through said coating when said body means and said substrate are moved linearly relative to each other, the width of said annular path corresponding to a transverse dimension of said core portion and the width of said linear path corresponding to a transverse dimension of said annular fluid pattern.

28. An apparatus for removing a coating from a surface of a substrate to which the coating is adhered, said apparatus comprising:

body means defining a chamber for receiving a pressurized fluid;

means for connecting said body chamber to a source of said pressurized fluid;

head means;

means for mounting said head means on said body means for rotation about a spin axis, said mounting means comprising a shaft member mounted in said body means for rotation about said spin axis and passing through said body chamber between opposing ends thereof;

at least one nozzle tip mounted on said head means and having a bore for receiving said pressurized fluid, and an orifice opening at an end of said bore for discharging said pressurized fluid against said coating as at least part of a focused stream of fluid having a velocity sufficient to remove from said substrate such portions of said coating as are impacted by a core portion of said stream;

means for conveying said pressurized fluid from said body chamber to said nozzle tip bore, said fluid conveying means comprising a passage extending along said shaft member in the direction of said spin axis and means providing fluid communication between said axial passage and said body chamber;

means for causing said head means to spin about said spin axis at least while said pressurized fluid is being discharged from said at least one nozzle tip, said orifice opening being positioned such that said spinning of the head means causes the core portion of said focused stream to provide an annular fluid pattern for cleaning an annular path through said coating when said body means is stationary relative to said substrate and a linear path through said coating when said body means and said substrate are move linearly relative to each other in a direction lateral to said spin axis, the width of said annular path corresponding to a transverse dimension of said core portion and the width of said linear path corresponding to a transverse dimension of said annular fluid pattern;

packing means positioned adjacent to at least one of said chamber ends and comprising a compressible packing portion arranged around said shaft member;

means for compressing said packing means such that said compressible portion engages an exterior surface of said shaft member to inhibit leakage of said pressurized fluid along the exterior surface of said shaft member, said compressible packing portion comprising an annular member comprising intertwined graphite and carbon ropes, an annular member comprising graphite and positioned on one side of said rope member, and an annular member positioned on the other side of said rope member and comprising a relatively hard synthetic resin such as KEVLAR, and said compressing means comprising a first hard annular member with one side adjacent to said graphite member, spring means engaging the other side of said first hard member, and a second hard member adjacent to said synthetic resin member; and, cooling means for providing auxiliary water at a pressure less than that of said pressurized fluid for cooling said body means and said packing means, said cooling means comprising passage means in said body means for providing a flow of said auxiliary water along a portion of said shaft member on a side of said packing means opposite from said body chamber.

29. An apparatus for removing a coating from a surface of a substrate to which the coating is adhered, said apparatus comprising:

body means defining a chamber for receiving a pressurized fluid;

means for connecting said body chamber to a source of said pressurized fluid;

head means;

means for rotatably mounting said head means on said body means;

at least one nozzle tip mounted on said head means and comprising a bore for receiving said pressurized fluid, an orifice opening at an end of said bore for discharging said pressurized fluid against said coating as at least part of a focused stream of fluid having a velocity sufficient to remove from said substrate such portions of said coating as are impacted by a core portion of said stream, and at least one lateral port for providing fluid communication between said bore and a source of secondary fluid, said bore having a first section of a first cross-sectional area immediately upstream of said orifice opening and a second section upstream of said first section, said second section having a second cross-sectional area in the vicinity of said lateral port(s) less than said first cross-sectional area such that when said primary fluid passes through said bore a suction force is created which draws said secondary fluid through said lateral port(s) and into said bore to be discharged through said orifice opening with said primary fluid;

means for conveying said pressurized fluid from said body chamber to said nozzle tip bore; and, means for causing said head means to rotate at least while said pressurized fluid is being discharged from said at least one nozzle tip, said orifice opening being positioned such that said rotation causes the core portion of said focused stream to provide a conical fluid pattern for cleaning a circular path through said coating when said body means is stationary relative to said substrate and a linear path through said coating when said body means and said substrate are moved linearly relative to each other, the diameter of said circular path and the width of said linear path corresponding to a transverse dimension of said conical fluid pattern.

30. An apparatus for removing a coating from a surface of a substrate to which the coating is adhered as said substrate travels along a path through a work station, said apparatus comprising:

body means defining a chamber for receiving a pressurized fluid;

means for connecting said body chamber to a source of said pressurized fluid when said substrate enters said work station and disconnecting said body chamber from said fluid source when said substrate leaves said work station;

head means;

means for mounting said head means on said body means for rotation about a spin axis;

at least one nozzle tip mounted on said head means and having a bore for receiving said pressurized fluid, and an orifice opening at an end of said bore for discharging said pressurized fluid along an axis of said orifice opening and against said coating as at least part of a focused stream of fluid having a velocity sufficient to remove from said substrate surface such portions of said coating as are impacted by a core portion of said stream;

means for conveying said pressurized fluid from said body chamber to said nozzle tip bore;

means for causing said head means to spin about said spin axis at least while said pressurized fluid is being discharged from said at least one nozzle tip, said orifice being positioned such that said spinning of the head means causes the core portion of said focused stream to provide a conical fluid pattern for cleaning a circular path through said coating when said body means is stationary relative to said substrate and a linear path through said coating when said body means and said substrate are moved linearly relative to each other in a direction lateral to said spin axis, the diameter of said circular path and the width of said linear path corresponding to a transverse dimension of said conical fluid pattern; and, means for mounting said body means such that said spin axis is substantially perpendicular to at least a portion of said substrate surface when said substrate is opposite to said head means, said mounting means providing for lateral movement of said body means in a direction toward and a direction away from said travel path through the work station such that said head means is maintained at a predetermined distance from the coating on said substrate surface irrespective of changes in a lateral dimension of the coated substrate, said predetermined distance being such that said core portion of the stream is effective to remove impacted portions of said coating from said substrate surface, and said body mounting means comprising:

an arm member;

means for supporting said arm member for pivotal movement around a pivotal connection;

means for mounting said body means on said arm member;

and bumper means for engaging an outer surface of said coating, said bumper means being mounted on said arm member in spaced relation to said body means such that said engagement causes said arm member to pivot around said pivotal connection and thereby maintain said head means at said predetermined distance from said coating.

* * * * *